US006156491A

United States Patent [19]

Goto

[11] Patent Number: 6,156,491

[45] Date of Patent: Dec. 5, 2000

[54] HEAT DEVELOPABLE LIGHT-SENSITIVE MATERIAL

[75] Inventor: Takahiro Goto, Kanagawa, Japan

[73] Assignee: Fuji Photo Film Co., Ltd., Kanagawa, Japan

[21] Appl. No.: 09/276,436

[22] Filed: Mar. 25, 1999

[30] Foreign Application Priority Data

Mar. 26, 1998 [JP] Japan ..... 10-079994

[51] Int. Cl.[7] ..... G03C 1/498; G03C 1/321

[52] U.S. Cl. ..... 430/619; 430/531; 430/613; 430/944; 430/598

[58] Field of Search ..... 430/264, 619, 430/945, 944, 531, 613, 607, 598

[56] References Cited

U.S. PATENT DOCUMENTS

| | | | |
|---|---|---|---|
| 4,956,260 | 9/1990 | Nakamura | 430/138 |
| 5,545,515 | 8/1996 | Murray et al. | 430/617 |
| 5,705,324 | 1/1998 | Murray | 430/350 |
| 5,958,667 | 9/1999 | Deroover et al. | 430/619 |
| 5,962,182 | 10/1999 | Katoh et al. | 430/264 |
| 6,030,764 | 2/2000 | Horsten et al. | 430/619 |

FOREIGN PATENT DOCUMENTS

| | | |
|---|---|---|
| 0559228 A1 | 9/1993 | European Pat. Off. . |
| 3041446A | 2/1991 | Japan . |

*Primary Examiner*—Thorl Chea
*Attorney, Agent, or Firm*—Birch, Stewart, Kolasch & Birch, LLP

[57] ABSTRACT

A heat-developable light-sensitive material comprising a support and at least one image-forming layer, and containing a light-insensitive silver salt, a light-sensitive silver halide and a binder, wherein the light-sensitive material comprises at least one image-forming layer which contains: a light-sensitive silver halide which has been spectrally sensitized to from 750 to 1,400 nm; and a binder comprising a polymer latex having a glass transition temperature of from −30° C. to 40° C. in an amount of not less than 50 wt % based on the total weight thereof, and wherein the light-sensitive material further contains a nucleating agent and at least one compound represented by formula (I) in an image-forming layer or a layer adjacent thereto:

(I)

wherein R represents a hydrogen atom, an alkyl group having from 1 to 4 carbon atoms, an aryl group, a halogen atom, an amino group, a nitro group, a substituted or unsubstituted carboxylic acid group or a salt thereof, or a sulfonic acid group or a salt thereof.

12 Claims, 1 Drawing Sheet

HEAT DEVELOPABLE LIGHT-SENSITIVE MATERIAL

FIELD OF THE INVENTION

The present invention relates to a heat developable light-sensitive material, particularly a heat developable light-sensitive material for use in the photomechanical process. More specifically, the present invention relates to a heat developable light-sensitive material for scanners or image setters, particularly, a heat developable light-sensitive material reduced in fog, having good storage stability and capable of giving high contrast characteristics.

BACKGROUND OF THE INVENTION

A large number of light-sensitive materials comprising a support having thereon a light-sensitive layer are known, where the image formation is performed by imagewise exposing the light-sensitive material. Of these, a technique of forming an image by heat development is a system capable of satisfying the issue of environmental conservation or simplifying the image formation means.

In recent years, reduction of the amount of waste processing solutions is keenly demanded in the field of photomechanical process from the standpoint of environmental conservation and space savings. To cope with this, techniques are required to produce light-sensitive heat-developable materials for use in photomechanical process, which can be effectively exposed by a laser scanner or laser image setter and can form a clear black image having high resolution and sharpness. Such light-sensitive heat-developable materials can provide to users a heat development processing system being dispensable with use of solution-type processing chemicals, simple and freed from incurring environmental destruction.

Methods for forming an image by heat development are described, for example, in U.S. Pat. Nos. 3,152,904 and 3,457,075 and D. Morgan and B. Shely, *Imaging Processes and Materials, "Thermally Processed Silver Systems" A,* 8th ed., page 2, compiled by Sturge, V. Walworth and A. Shepp, Neblette (1969). The light-sensitive material used contains a light-insensitive silver source (e.g., organic silver salt) capable of reduction, a photocatalyst (e.g., silver halide) in a catalytic activity amount, and a reducing agent for silver, which are usually dispersed in an organic binder matrix. This light-sensitive material is stable at room temperature, however, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

This type of heat-developable light-sensitive material has been heretofore known but in many of such light-sensitive materials, the light-sensitive layer is formed by coating a coating solution using an organic solvent such as toluene, methyl ethyl ketone (MEK) or methanol, as a solvent. However, use of an organic solvent as a solvent is not preferred because of its adverse effect on a human body during the production process or in view of the cost for recovery or the like of the solvent.

Accordingly, a method of forming a light-sensitive layer by coating a coating solution using a water solvent free of the above-described problems has been proposed. For example, JP-A-49-52626 (the term "JP-A" as used herein means an "unexamined published Japanese patent application") and JP-A-53-116144 describe the use of gelatin as a binder and JP-A-50-1-51138 describes the use of polyvinyl alcohol as a binder.

Furthermore, JP-A-60-61747 describes the use of gelatin and polyvinyl alcohol in combination. In addition, JP-A-58-28737 describes a light-sensitive layer using a water-soluble polyvinyl alcohol as a binder.

Certainly, when such a binder is used, a light-sensitive layer can be formed using a coating solution comprising a water solvent, and this is advantageous in view of the environmental issue and cost.

However, when a polymer such as gelatin, polyvinyl alcohol or water-soluble polyacetal is used as a binder, the coating obtained has a coated surface of which properties cannot endure the practical use, because the compatibility of the polymer with an organic silver salt is poor. Moreover, the silver tone at the developed area becomes brown or yellow and quite differs from black which is regarded as a proper color and preferred, or the blacking density in the exposed area is low and the density in the unexposed area is high, thus, the commercial value is seriously impaired.

European Patent 762,196 and JP-A-9-90550 disclose a technique of incorporating Group VII or VIII metal ion or metal complex ion into a light-sensitive silver halide grain for use in a heat-developable light-sensitive material and incorporating a hydrazine derivative into the light-sensitive material, whereby a high-contrast photographic property can be obtained. If a binder for use in the above-described water solvent-type coating solution and a nucleating agent such as hydrazine are used in combination, a high-contrast image may be obtained but a problem arises at the same time such that fog is readily generated. The fog disadvantageously increases with the passing of the time.

On the other hand, the semiconductor laser technique abruptly growing in recent years has made it feasible to miniaturize an image output device for use in the medical art. Naturally, techniques have been developed for an infrared ray-sensitive photothermic silver halide photographic material which can use a semiconductor laser as a light source. In this respect, spectral sensitization techniques are disclosed in JP-A-3-10391, JP-B-6-52387, JP-A-5-341432, JP-A-6-194781 and JP-A-6-301141 and antihalation techniques are disclosed in JP-A-7-13295 and U.S. Pat. No. 5,380,635. The light-sensitive material contingent on infrared exposure can be greatly reduced in the visible ray absorption of the sensitizing dye or antihalation dye and a substantially colorless light-sensitive material can be easily produced.

However, the dye which absorbs an infrared ray and undergoes spectral sensitization generally has a high HOMO and a strong reducing ability and reduces silver ion in the light-sensitive material, as a result, the fog of the light-sensitive material is liable to grow worse. In particular, storage under high temperature and high humidity conditions or storage for a long period of time may cause conspicuous changes in the performance. If a dye having a low HOMO is used so as to prevent deterioration in the storage stability, the LUMO becomes low in turn, as a result, the spectral sensitization efficiency is reduced to give low sensitivity. Such problems with regard to the sensitivity, storage stability or change in the performance not only arise in a wet photographic light-sensitive material but also become more serious in a heat-developable light-sensitive material.

Under these circumstances, a technique of providing a heat-developable light-sensitive material having photographic capabilities such as good coated surface property, good silver tone at the development, high contrast, low fog and good storage stability, as an aqueous light-sensitive material advantageous from the aspect of environmental issue and cost, has been demanded.

SUMMARY OF THE INVENTION

Accordingly, an object of the present invention is to provide a heat-developable light-sensitive material for use in photomechanical process, particularly, for a scanner or image setter, having photographic properties of high contrast, low fog and good storage stability.

Other objects and effects of the present invention will become apparent from the following description.

The above-described objects of the present invention have been achieved by providing the following heat-developable light-sensitive materials.

1) A heat-developable light-sensitive material comprising a support and at least one image-forming layer, and containing a light-insensitive silver salt, a light-sensitive silver halide and a binder, wherein the light-sensitive material comprises at least one image-forming layer which contains:

a light-sensitive silver halide which has been spectrally sensitized to from 750 to 1,400 nm; and a binder comprising a polymer latex having a glass transition temperature of from −30° C. to 40° C. in an amount of not less than 50 wt % based on the total weight thereof, and wherein the light-sensitive material further contains a nucleating agent and at least one compound represented by formula (I) in an image-forming layer or a layer adjacent thereto:

(I)

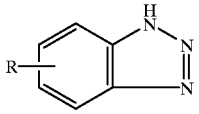

wherein R represents a hydrogen atom, an alkyl group having from 1 to 4 carbon atoms, an aryl group, a halogen atom, an amino group, a nitro group, a substituted or unsubstituted carboxylic acid group or a salt thereof, or a sulfonic acid group or a salt thereof.

2) The heat-developable light-sensitive material of the above 1), wherein the nucleating agent is at least one compound selected from a substituted alkene derivative represented by formula (1), a substituted isooxazole derivative represented by formula (2) and a specific acetal compound represented by formula (3):

(1)

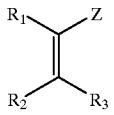

-continued (2)

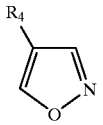

(3)

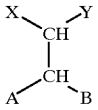

wherein, in formula (1), $R_1$, $R_2$ and $R_3$ each independently represents a hydrogen atom or a substituent, Z represents an electron withdrawing group or a silyl group, and $R_1$ and Z, $R_2$ and $R_3$, $R_1$ and $R_2$ or $R_3$ and Z may be combined with each other to form a ring structure;

wherein, in formula (2), $R_4$ represents a substituent; and wherein, in formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y or A and B may be combined with each other to form a ring structure.

3) The heat-developable light-sensitive material of the above 1), wherein the nucleating agent is a hydrazine compound.

DETAILED DESCRIPTION OF THE INVENTION

Figure 1:
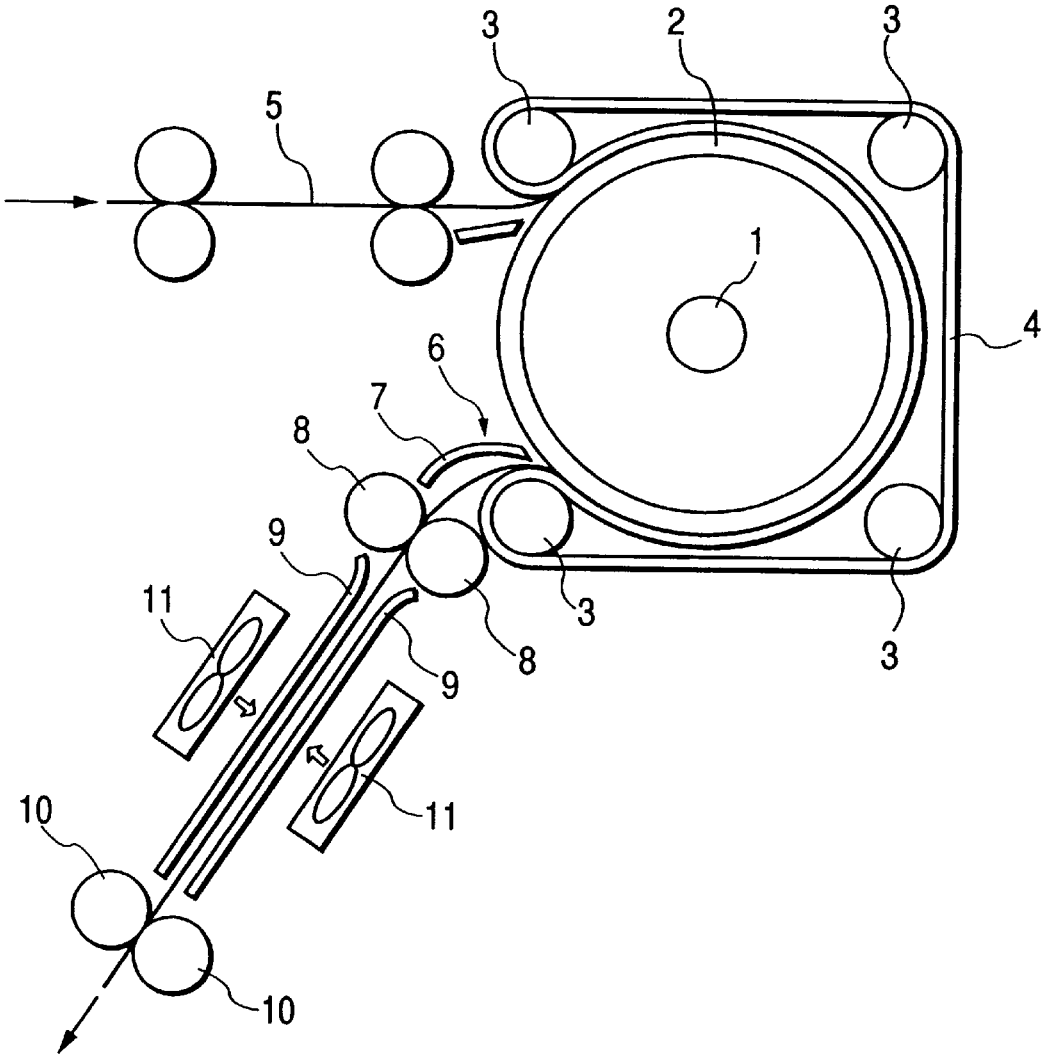
FIG. 1 is a side view illustrating one example of the constitution of a heat-developing apparatus for use in the present invention.

The present invention is described in detail below.

The compound represented by formula (I) is described below.

The compound represented by formula (I) is a benzotriazole, wherein R represents a hydrogen atom, an alkyl group having from 1 to 4 carbon atoms, an aryl group, a halogen atom, an amino group, a nitro group, a substituted or unsubstituted carboxylic acid group or a salt thereof, or a sulfonic acid group or a salt thereof.

Examples of the alkyl group having from 1 to 4 carbon atoms represented by R include a methyl group, an ethyl group and a butyl group. Examples of the aryl group include a phenyl group, a chlorine atom or a bromine atom. Examples of the salt of the carboxylic acid group or sulfonic acid group include an alkali metal salt such as sodium salt and potassium salt.

Specific examples of the compound represented by the following formula (I) are shown below, however, the present invention is by no means limited thereto.

I-1

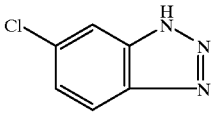

-continued

I-2

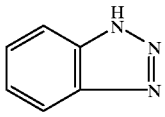

I-3

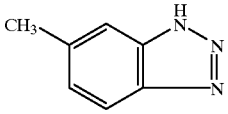

I-4

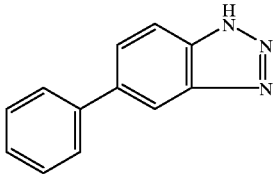

I-5

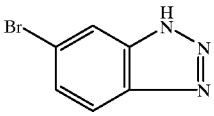

I-6

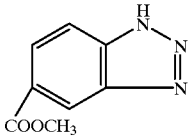

I-7

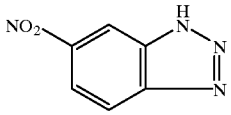

I-8

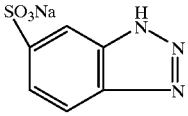

The compound represented by formula (I) of the present invention may be added to a light-sensitive layer which is an image-forming layer, or other light-insensitive layers but the compound is preferably added to an image-forming layer.

The compound represented by formula (I) of the present invention is generally added in an amount of from $10^{-4}$ tp 1 mol, preferably from $10^{-4}$ to 0.3 mol, per mol of the entire amount of silver. The compound represented by formula (I) may be added alone or two or more of the compounds may be added in combination.

Examples of the dye which is spectrally sensitized to the wavelength region of from 750 to 1,400 nm for use in the present invention include various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patents 1,466,201, 1,469,117 and 1,422,057, JP-B-3-10391 (the term "JP-B" as used herein means an "examined Japanese patent publication"), JP-B-6-51387, JP-A-5-341432, JP-A-6-194781 and JP-A-6-301141.

The dye is particularly preferably a cyanine dye having a thioether bond and examples thereof include cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425 and JP-W-A-7-500926 (the term "JP-W-A" as used herein means an "published Japanese national stage of international application").

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in *Research Disclosure,* Vol. 176, 17643, page 23, Item IV-J (December, 1978), JP-B-49-25500, JP-B-43-4933, JP-A-59-29032 and JP-A-59-192242.

The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermoe, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultraviolet wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog, however, it is preferably from $10^{-6}$ to 1 mol, more preferably from $10^{-4}$ to $10^{-1}$ mol, per mol of silver halide in the light-sensitive layer.

The organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70 wt % of the image-forming layer. The preferred organic silver salt includes a silver salt of an organic compound having a carboxyl group. Examples thereof include an aliphatic carboxylic acid silver salt and an aromatic carboxylic acid silver salt, however, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Of these organic acid silvers and combinations of the organic acid silvers, preferred in the present invention is an organic acid silver having a silver behenate content of 85 mol % or more, more preferably 95 mol % of more. The term "silver behenate content" as used herein means a partial ratio in mol of the silver behenate to the organic acid silver used. Preferred examples of the organic acid silver other than silver behenate, contained in the organic acid silver for use in the present invention include the above-described organic acid silvers.

The organic acid silver preferred in the present invention is prepared by reacting an alkali metal salt (e.g., Na salt, K salt, Li salt) solution or suspension of the above-described organic acid with silver nitrate. The organic acid alkali metal salt for use in the present invention can be obtained by treating the organic acid with an alkali. The reaction of the organic acid silver for use in the present invention may be performed batchwise or continuously in any appropriate reaction vessel while stirring and the stirring may be effected by any stirring method according to the required properties of the grain. The organic acid silver is preferably prepared by a method of gradually or rapidly adding an aqueous silver nitrate solution to the reaction vessel containing an organic acid alkali metal solution or suspension, a method of gradually or rapidly adding a previously prepared organic acid alkali metal salt solution or suspension to the reaction vessel containing an aqueous silver nitrate solution, or a method of previously preparing an aqueous silver nitrate solution and an organic acid alkali metal salt solution or suspension and simultaneously adding those solutions to the reaction vessel.

The aqueous silver nitrate solution and the organic acid alkali metal salt solution or suspension may have any concentration so as to control the grain size of the organic acid silver prepared and may be added at any addition rate. The aqueous silver nitrate solution and the organic acid alkali metal salt solution or suspension each may be added by a method of adding the solution at a constant rate or a method of adding the solution while increasing or decreasing the addition rate with any time function. The solution may also be added to the liquid surface or in the liquid of the reaction solution. When an aqueous silver nitrate solution and an organic acid alkali metal salt solution or suspension are previously prepared and then simultaneously added to a reaction vessel, either of the aqueous silver nitrate solution and the organic acid alkali metal salt solution or suspension may be added in advance but the aqueous silver nitrate solution is preferably added in advance by a precedence degree of from 0 to 50%, more preferably from 0 to 25%, of the entire addition amount. Furthermore, a method of adding the solution while controlling the pH or silver potential of the reaction solution during the reaction described in JP-A-9-127643 may be preferably used.

The pH of the aqueous silver nitrate solution and the organic acid alkali metal salt solution or suspension added may be adjusted according to the required properties of the grain. For adjusting the pH, any acid or alkali may be added. Furthermore, depending on the required property of the grain, for example, in order to control the grain size of the organic acid silver prepared, the temperature in the reaction vessel may be freely selected. The temperature of the aqueous silver nitrate solution and the organic acid alkali metal salt solution or suspension added may also be freely controlled. In order to ensure the liquid flowability of the organic acid alkali metal salt solution or suspension, the solution is preferably heat-insulated by heating at 50° C. or more.

The organic acid silver for use in the present invention is preferably prepared in the presence of a tertiary alcohol. The tertiary alcohol preferably has a total carbon number of 15 or less, more preferably 10 or less. Examples of preferred tertiary alcohols include tert-butanol, however, the present invention is by no means limited thereto.

The tertiary alcohol for use in the present invention may be added in any timing during the preparation of the organic acid silver but the tertiary alcohol is preferably added at the time o preparation of the organic acid alkali metal salt to dissolve the organic alkali metal salt. The tertiary alcohol for use in the present invention may be added in any amount of from 0.01 to 10 in terms of the weight ratio to $H_2O$ used as a solvent at the preparation of the organic acid silver but preferably added in an amount of from 0.03 to 1 in terms of the weight ratio to $H_2O$.

The shape of the organic silver salt which can be used in the present invention is not particularly limited but an acicular crystal form having a short axis and a long axis is preferred. In the present invention, the short axis is preferably from 0.01 to 0.20 μm, more preferably from 0.01 to 0.15 μm, and the long axis is preferably from 0.10 to 5.0 μm, more preferably from 0.10 to 4.0 μm. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method of obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelation function of the fluctuation of the scattered light to the change in time.

The organic silver salt which can be used in the present invention is preferably desalted. The desalting method is not particularly limited and a known method may be used. Known filtration methods such as centrifugal filtration, suction filtration, ultrafiltration and flocculation washing by coagulation may be preferably used.

In order to obtain an organic silver salt solid dispersion having a high S/N ratio and a small grain size and being free of coagulation, a dispersion method of converting a water dispersion containing an organic silver salt as an image-forming medium and containing substantially no light-sensitive silver salt into a high-speed flow and then pressure-dropping the flow is preferably used in the present invention.

The organic silver salt dispersion thus obtained is then mixed with an aqueous light-sensitive silver salt solution to produce a light-sensitive image-forming medium coating solution. When a heat-developable light-sensitive material is manufactured using this coating solution, the heat-developable light-sensitive material obtained can have low haze, low fog and high sensitivity. However, if a light-sensitive silver salt is present together at the time of dispersion by converting the organic silver salt solution into a high-pressure high-speed flow, fog increases and sensitivity extremely decreases. Furthermore, if an organic solvent but not water is used as the dispersion medium, haze and fog increase and sensitivity readily decreases. If a conversion method where a part of the organic silver salt in the dispersion is converted into light-sensitive silver salt is used in place of the method of mixing an aqueous light-sensitive silver salt solution, sensitivity decreases.

The above-described water dispersion obtained using conversion into a high-pressure and high-speed flow is substantially free of a light-sensitive silver salt. The content thereof is 0.1 mol % or less based on the light-insensitive organic silver salt. A light-sensitive silver salt is not positively added.

The solid dispersing apparatus and technique used for performing the above-described dispersion method in the present invention are described in detail, for example, in Toshio Kajiuchi and Hiromoto Usui, *Bunsan-Kei Rheology to Bunsanka Gijutsu* (*Rheology of Dispersion System and Dispersion Technology*), pp. 357–403, Shinzan Sha Shuppan (1991), and *Kagaku Kogaku no Shinpo* (*Progress of Chemical Engineering*), pp. 184–185, compiled by Corporation Kagaku Kogakukai Tokai Shibu, Maki Shoten (1990). The dispersion method used in the present invention is a method of feeding a water dispersion containing at least an organic silver salt under pressurization by means of a high-pressure pump or the like into a pipeline, passing the dispersion through a thin slit provided within the pipeline, and then generating abrupt pressure reduction in this dispersion, thereby attaining fine dispersion.

In the high-pressure homogenizer which may be used in the present invention, it is considered that the dispersion into fine grains generally proceeds by the dispersion force such as (a) "shear force" generated at the time of the dispersoid passing through a narrow slit under a high pressure at a high speed and (b) "cavitation force" generated at the time of the dispersoid being liberated from the high pressure into normal pressure. As the dispersion apparatus of this type, Golline homogenizer has been known of old. In this apparatus, the solution to be dispersed is transported under a high pressure and converted into a high-speed flow through a narrow slit on the cylinder plane to generate a force of colliding the solution against the peripheral wall surface. The emulsifiction/dispersion is effected by the impulsive force at this time. The pressure used is generally from 100 to 600 kg/cm$^2$ and the flow velocity is from a few m/sec to 30 m/sec. In order to increase the dispersion efficiency, some apparatuses are designed such that the high flow velocity part is formed into a serrated shape to thereby increase the frequency of collision. On the other hand, apparatuses capable of dispersion under a higher pressure at a higher flow velocity have been developed in recent years and representative examples thereof include Microfluidizer (manufactured by Microfluidex International Corporation) and Nanomizer (manufactured by Tokusho Kika Kogyo KK)

Examples of the dispersing apparatus which can be suitably used in the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all manufactured by Microfluidex International Corporation.

In such an apparatus, a water dispersion containing at least an organic silver salt is transported under pressurization by means of a high-pressure pump or the like into the pipeline, the solution is passed though a thin slit provided within the pipeline to apply a desired pressure and then the pressure within the pipeline is rapidly returned to the atmospheric pressure, so that an optimal organic silver salt dispersion for use in the present invention can be obtained.

In advance of the dispersion operation, the stock solution is preferably subjected to preparatory dispersion. The preparatory dispersion may be performed using a known dispersion means (for example, a high-speed mixer, a homogenizer, a high-speed impact mill, a Banbary mixer, a homomixer, a kneader, a ball mill, a vibrating ball mill, a planetary ball mill, an attriter, a sand mill, a bead mill, a colloid mill, a jet mill, a roller mill, a trone mill or a high-speed stone mill). Other than the mechanical dispersion, the stock solution may be coarsely dispersed in a solvent by controlling the pH and thereafter formed into fine grains in the presence of a dispersion aid by changing the pH. At this time, the solvent used for the coarse dispersion may be an organic solvent. The organic solvent is usually removed after the completion of fine grain formation.

In dispersing the organic silver salt for use in the present invention, dispersion to have a desired grain size may be attained by controlling the flow velocity, the difference in the pressure at the pressure dropping and the frequency of the processing. In view of the photographic properties and the grain size, the flow velocity is preferably from 200 to 600 m/sec, more preferably from 300 to 600 m/sec, and the difference in the pressure at the pressure dropping is preferably from 900 to 3,000 kg/cm$^2$, more preferably from 1,500 to 3,000 kg/cm$^2$. The frequency of the dispersion processing may be selected according to the necessity but it is usually from 1 to 10 times and in view of the productivity, it is approximately from 1 to 3 times. The water dispersion under high pressure is preferably not allowed to stand in a high temperature condition in view of the dispersibility and photographic properties. At a high temperature in excess of 90° C., a large grain size readily results and fog is liable to increase. Accordingly, in the present invention, the water dispersion is preferably kept at a temperature of from 5 to 90° C., more preferably from 5 to 80° C., still more preferably from 5 to 65° C., by providing a cooling step before the conversion into high pressure and high flow velocity, after the pressure drop or both before the conversion and after the pressure drop. It is particularly effective to provide the cooling step at the time of dispersion under a high pressure of from 1,500 to 3,000 kg/cm$^2$. The cooler may be appropriately selected from a double pipe, a double piper using a static mixer, a tubular exchanger and a coiled heat exchanger, according to the necessary heat exchange amount. The size, wall thickness or construction material of the pipe may be appropriately selected so as to increase the heat exchange efficiency taking account of the pressure used. In view of the heat exchange amount, the refrigerant used in the cooler may be a well water at 20° C. or a chilled water at from 5 to 10° C. treated in a refrigerator, and if desired, a refrigerant such as ethylene glycol/water at −30° C. may also be used.

In the dispersion operation of the present invention, the organic silver salt is preferably dispersed in the presence of a dispersant (dispersion aid) soluble in an aqueous solvent. Examples of the dispersion aid include synthetic anion polymers such as polyacrylic acid, copolymer of acrylic acid, maleic acid copolymer, maleic acid monoester copolymer and acrylomethylpropane sulfonic acid copolymer, semisynthetic anion polymers such as carboxymethyl starch and carboxymethyl cellulose, anionic polymers such as alginic acid and pectic acid, compounds described in JP-A-7-350753, known anionic, nonionic or cationic surface active agents, known polymers such as polyvinyl alcohol, polyvinyl pyrrolidone, carboxymethyl cellulose, hydroxypropyl cellulose and hydroxypropylmethyl cellulose, and polymer compounds present in the nature such as gelatin. These may be appropriately selected and used. Of these, polyvinyl alcohols and water-soluble cellulose derivatives are preferred.

The dispersion aid is generally mixed with an organic silver salt powder or an organic silver salt in the wet cake state before the dispersion and fed as a slurry into the dispersing machine, but the dispersion aid may also be previously mixed with an organic silver salt and then subjected to heat treatment or treatment with a solvent to form an organic silver salt powder or wet cake. Before, after or during the dispersion, the pH may be controlled by an appropriate pH adjusting agent.

The dispersion prepared may be stored while stirring so as to prevent the precipitation of fine grains during the storage or may be stored in the high viscosity condition using a hydrophilic colloid (for example, in the jellied state using gelatin). Also, an antiseptic may be added so as to inhibit proliferation of microorganisms during the storage.

The grain size (volume-weighted mean diameter) of the organic silver salt solid fine grain dispersion for use in the present invention can be determined, for example, by irradiating a laser ray on the solid fine grain dispersion dispersed in a solution and determining an autocorrelation function of the fluctuation of the scattered light to the change in time. The solid fine grain dispersion preferably has an average grain size of from 0.05 to 10.0 $\mu$m, more preferably from 0.1 to 5.0 $\mu$m, still more preferably from 0.1 to 2.0 $\mu$m.

The organic silver salt preferably has a monodisperse grain size distribution. More specifically, the percentage (coefficient of variation) of the value obtained by dividing the standard deviation of the volume load average diameter by the volume load average diameter is preferably 80% or less, more preferably 50% or less, still more preferably 30% or less.

The shape of the organic silver salt can be determined by the image of the organic silver salt dispersion observed through a transmission type electron microscope.

The organic silver salt solid fine grain dispersion for use in the present invention comprises at least an organic silver salt and water. The ratio of the organic silver salt to water is not particularly limited, however, the organic silver salt preferably accounts for from 5 to 50 wt %, more preferably from 10 to 30 wt % of the entire dispersion. A dispersion aid is preferably used as described above but it is preferably used in a minimum amount within the range suitable for attaining a minimum grain size, specifically, in an amount of from 1 to 30 wt %, more preferably from 3 to 15 wt %, based on the organic silver salt.

In the present invention, a light-sensitive material may be produced by mixing an organic silver salt water dispersion and a light-sensitive silver salt water dispersion. The mixing ratio of the organic silver salt and the light-sensitive silver salt may be selected according to the purpose, however, the ratio of the light-sensitive silver salt to the organic silver salt is preferably from 1 to 30 mol %, more preferably from 3 to 20 mol %, still more preferably from 5 to 15 mol %. In the mixing, it is preferred to mix two or more organic silver salt water dispersions with two or more light-sensitive silver salt water dispersions, so that the photographic properties can be controlled.

The organic silver salt for use in the present invention may be used in any desired amount, however, it is preferably used in an amount of from 0.1 to 5 g/m$^2$, more preferably from 1 to 3 g/m$^2$, in terms of silver.

The halogen composition of the light-sensitive silver halide for use in the present invention is not particularly limited and any of silver chloride, silver chlorobromide, silver bromide, silver iodobromide and silver iodochlorobromide may be used. The halogen composition distribution within the grain may be uniform or the halogen composition may be stepwise or continuously changed. A silver halide grain having a core/shell structure may be preferably used. With respect to the structure thereof, core/shell grains having from 2 to 5-ply structure, more preferably from 2 to 4-ply structure may be used. Furthermore, a technique of localizing silver bromide on the surface of silver chloride or silver chlorobromide grain may also be preferably used.

The method of forming light-sensitive silver halide is well known in the art and, for example, the methods described in *Research Disclosure,* No. 17029 (June, 1978) and U.S. Pat. No. 3,700,458 may be used and specifically, a method of adding a silver-supplying compound and a halogen-supplying compound to gelatin or other polymer solution to thereby prepare light-sensitive silver halide and mixing the silver halide with an organic silver salt is used. The light-sensitive silver halide grain preferably has a small grain size so as to prevent high white turbidness after the formation of an image. Specifically, the grain size is preferably 0.20 μm or less, more preferably from 0.01 to 0.15 μm, still more preferably from 0.02 to 0.12 μm. The term "grain size" as used herein means the length of an edge of the silver halide grain in the case where the silver halide grain is a regular crystal such as cubic or octahedral grain; the diameter of a circle image having the same area as the projected area of the main surface plane in the case where the silver halide grain is a tabular silver halide grain; and the diameter of a sphere having the same volume as the silver halide grain in the case of other irregular crystals such as spherical or bar grain.

Examples of the shape of the silver halide grain include cubic form, octahedral form, tabular form, spherical form, stick form and bebble form, and among these, cubic grain and tabular grain are preferred in the present invention. When a tabular silver halide grain is used, the average aspect ratio is preferably from 100:1 to 2:1, more preferably from 50:1 to 3:1. A silver halide grain having rounded corners is also preferably used. The face index (Miller indices) of the outer surface plane of a light-sensitive silver halide grain is not particularly limited, however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, *J. Imaging Sci.,* 29, 165 (1985) using the adsorption dependency of [111] face and [100] face upon adsorption of the sensitizing dye.

The light-sensitive silver halide grain for use in the present invention contains a metal or metal complex of Group VII or VIII in the Periodic Table. The center metal of the metal or metal complex of Group VII or VIII of the Periodic Table is preferably rhodium, rhenium, ruthenium, osnium or iridium. One metal complex may be used or two or more complexes of he same metal or different metals may also be used in combination. The metal complex content is preferably from $1\times10^{-9}$ to $1\times10^{-3}$ mol, more preferably from $1\times10^{-8}$ to $1\times10^{-4}$ mol, per mol of silver. With respect to the specific structure of the metal complex, the metal complexes having the structures described in JP-A-7-225449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachloro-diaquorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method of adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide grains previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion grains or at respective stages before coating of the emulsion, however, the rhodium compound is preferably added at the time of formation of the emulsion and integrated into the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | |

The addition amount of these compound is preferably from $1\times10^{-9}$ to $1\times10^{-5}$ mol, more preferably from $1\times10^{-8}$ to $1\times10^{-6}$ mol, per mol of silver halide.

These compound may be added appropriately at the time of preparation of silver halide emulsion grains or at respective stages before coating of the emulsion, but the compound is preferably added at the time of formation of the emulsion and integrated into a silver halide grain.

For adding the compound during the grain formation of silver halide and integrating it into a silver halide grain, a method where a metal complex powder or an aqueous solution having dissolved therein the metal complex together with NaCl or KCl is added to a water-soluble salt or water-soluble halide solution during the grain formation, a method where the compound is added as the third solution at the time of simultaneously mixing a silver salt and a halide solution to prepare silver halide grains by the triple jet method, or a method where a necessary amount of an aqueous metal complex solution is poured into a reaction vessel during the grain formation, may be used. Among these, preferred is a method of adding a metal complex powder or an aqueous solution having dissolved therein the metal complex together with NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachloronitrosyliridium. The iridium compound is used after dissolving it in water or an appropriate solvent, and a method commonly used for stabilizing the iridium compound solution, more specifically, a method of adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide.

The silver halide grain for use in the present invention may further contain a metal atom such as cobalt, nickel, chromium, palladium, platinum, gold, thallium, copper and lead. In the case of a cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion, however, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount or from $1\times10^{-9}$ to $1\times10^{-4}$ mol per mol of silver halide. The metal may be converted into a metal salt in the form of a simple salt, a composite salt or a complex salt and added at the time of preparation of grains.

The light-sensitive silver halide grain may be desalted by water washing according to a method known in the art, such as noodle washing and flocculation, but the grain may not be desalted in the present invention.

The gold sensitizer used when the silver halide emulsion for use in the present invention is subjected to gold sensitization may have a gold oxidation number of either +1 or +3 valence and a gold compound commonly used as the gold sensitizer may be used. Representative examples thereof include chloroaurate, potassium chloroaurate, auric trichloride, potassium auric thiocyanate, potassium iodoaurate, tetracyanoauric acid, ammonium aurothiocyanate and pyridyltrichlorogold.

The amount of the gold sensitizer added may vary depending on various conditions, but the addition amount is generally from $10^{-7}$ to $10^{-3}$ mol, preferably from $10^{-6}$ to $5\times10^{-4}$ mol, per mol of silver halide.

The silver halide emulsion for use in the present invention is preferably subjected to a combination of bold sensitization and another chemical sensitization. Another chemical sensitization may be performed using a known method such as sulfur sensitization, selenium sensitization, tellurium sensitization or noble metal sensitization. When these sensitization methods are used in combination with gold sensitization, a combination of sulfur sensitization and gold sensitization, a combination of selenium sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain, however, it is preferably from $10^{-7}$ to $10^{-2}$ mol, more preferably from $10^{-5}$ to $10^{-4}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-3-121798. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis(oxycarbonyl) tellurides, bis(carbamoyl) tellurides, diacyl tellurides, bis(oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-3-53693, JP-A-3-131598, JP-A-4-129787, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai (compiler), The *Chemistry of Organic Selenium and Tellurium Compounds,* Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions, however, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted, however, the pH is from 5 to 8, the pAg is from 6 to 11, preferably from 7 to 10, and the temperature is from 40 to 95° C., preferably from 45 to 85° C.

In the silver halide emulsion for use in the present invention, a cadmium salt, a sulfite, a lead salt or a thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917.

In the light-sensitive material for use in the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the light-sensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing light-sensitive silver halide and organic silver salt which are prepared separately are not particularly limited as far as the effect of the present invention can be brought out satisfactorily, however, a method of mixing the silver halide grains and the organic silver salt after completion of respective preparations in a high-speed stirring machine, a ball mill, a sand mill, a colloid mill, a vibrating mill or a homogenizer, or a method of preparing organic silver salt while mixing therewith light-sensitive silver halide after completion of the preparation in any timing during preparation of the organic silver salt, may be used.

The thermal image-forming material of the present invention preferably contains a reducing agent for organic silver salt. The reducing agent for organic silver salt may be any substance, preferably an organic substance, which reduces the silver ion to metal silver. Conventional photographic developers such as phenidone, hydroquinone and catechol are useful, however, a hindered phenol reducing agent is preferred. The reducing agent is preferably contained in an amount of from 5 to 50 wt %, more preferably from 10 to 40 mol %, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50 mol % per mol of silver. The reducing agent may also be a so-called precursor which is derived to effectively exhibit the function only at the time of development.

For the heat-developable light-sensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328 and European Patent 692732. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2'-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydro-dihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid fine particle dispersion. The solid fine particle dispersion is performed using a known pulverizing means (e.g., ball mill, vibrating ball mill, sand mill, colloid mill, jet mill, roller mill). At the time of solid fine particle dispersion, a dispersion aid may also be used.

When an additive known as a "color toner" capable of improving the image is added, the optical density increases in some cases. Also, the color toner is advantageous in forming a black silver image depending on the case. The color toner is preferably contained on the surface having an image-forming layer in an amount of from 0.1 to 50 mol %, more preferably from 0.5 to 20 mol %, per mol of silver. The color toner may be a so-called precursor which is derived to effectively exhibit the function only at the time of development.

For the heat-developable light-sensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent 1,380,795 and Belgian Patent 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuronium-trifluoroacetate) and 2-(tribromomethylsulfonyl)benzothiazole; 3-ethyl-5-[(3-ethyl-2-benzothiazolinylidene)-1-methyl-ethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, 6-isobutylphthalazine, 6-tert-butylphthalazine, 5,7-dimethylphthalazine, 2,3-dihydrophthalazine) and metal salts thereof; combinations of a phthalazine, a phthalazine derivative and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be added in any form of a solution, a powder and a solid fine particle dispersion. The solid fine particle dispersion is performed using a known pulverization means (e.g., ball mill, vibrating ball mill, sand mill, colloid mill, jet mill, roller mill). At the time of solid fine particle dispersion, a dispersion aid may also be used.

At least one of the image-forming layers constituting the heat-developable light-sensitive material of the present invention is an image-forming layer in which at least 50 wt % of the binder thereof is a polymer latex described below (hereinafter this image-forming layer is referred to as an "image-forming layer of the present invention" and the polymer latex used as the binder is referred to as a "polymer latex of the present invention"). The polymer latex may be used not only in the image-forming layer but also in the protective layer or the back layer. In the case when the heat-developable light-sensitive material of the present invention is used for printing in which the change in dimension causes a problem, the polymer latex is necessary to be used also in the protective layer or the back layer. The "polymer latex" as used herein means a polymer latex comprising a water-soluble dispersion medium having dispersed therein water-insoluble hydrophobic polymer fine particles. With respect to the dispersion state, the polymer may be emulsified in the dispersion medium, emulsion-polymerized or micell dispersed or may be in the condition such that the polymer has a partially hydrophilic structure in the polymer molecule and the molecular chain itself is molecular dispersed. The polymer latex for use in the present invention is described in *Gosei Jushi Emulsion* (*Synthetic Resin Emulsion*), compiled by Taira Okuda and Hiroshi Inagaki, issued by Kobunshi Kanko Kai (1978), *Gosei Latex no Oyo* (*Application of Synthetic Latex*), compiled by Takaaki Sugimura, Yasuo Kataoka, Souichi Suzuki and Keishi Kasahara, issued by Kobunshi Kanko Kai (1993), and Soichi Muroi, *Gosei Latex no Kaaaku* (*Chemistry of Synthetic Latex*), Kobunshi Kanko Kai (1970). The dispersion particles preferably has an average particle size of from 1 to 50,000 nm, more preferably on the order of from 5 to 1,000 nm. The particle size distribution of the dispersed particles is not particularly limited and the dispersed particles may have a broad particle size distribution or a monodisperse particle size distribution.

As the polymer latex for use in the present invention, a so-called core/shell type latex may be used other than the normal polymer latex having a uniform structure. In this case, it is preferred in some cases that the core and the shell have different glass transition temperatures.

The polymer latex used as a binder in the present invention has a glass transition temperature (Tg) of which preferred range is different between the protective layer or back layer and the image-forming layer. In the image-forming layer, the glass transition temperature is from −30 to 40° C. so as to accelerate the diffusion of the photographically useful materials at the time of heat development, whereas in the protective layer or back layer, it is preferably from 25 to 70° C. because the layers are put into contact with various equipments.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and an organic compound (usually an organic solvent) capable of reducing the minimum film-forming temperature of the polymer latex is used therefor. This organic compound is described in Souichi Muroi, *Gosei Latex no Kaaaku* (*Chemistry of Synthetic Latex*), Kobunshi Kanko Kai (1970).

The polymer seed of the polymer latex for use in the present invention may be an acrylic resin, a vinyl acetate resin, a polyester resin, a polyurethane resin, a rubber-based resin, a vinyl chloride resin, a vinylidene chloride resin, a polyolefin resin or a copolymer thereof. The polymer may be a straight-chained polymer, a branched polymer or a cross-linked polymer. The polymer may be a so-called homopolymer obtained by polymerizing a single monomer or may be a copolymer obtained by polymerizing two or more monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film-forming property is disadvantageously poor.

Specific examples of the polymer latex used as a binder in the image-forming layer of the heat-developable light-sensitive material of the present invention include a methyl methacrylate/ethyl acrylate/methacrylic acid copolymer latex, a methyl methacrylate/2 ethylhexyl acrylate/styrene/acrylic acid copolymer latex, a styrene/butadiene/acrylic acid copolymer latex, a styrene/butadiene/divinylbenzene/methacrylic acid copolymer latex, a methyl methacrylate/vinyl chloride/acrylic acid copolymer latex and a vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo KK) and Nipol Lx811, 814, 821, 820, 857 (all produced by Nippon Zeon KK); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon KK); vinyl chloride resins such as G351, G756 (both produced by Nippon Zeon KK); vinylidene chloride resins such as L502, L513 (both produced by Asahi Chemical Industry Co., Ltd.), ARON D7020, D504 and D5071 (all produced by Mitsui-Toatsu KK); and olefin resins such as CHEMIPEARL S120 and SA100 (both produced by Mitsui Petrochemical Industries, Ltd.). These polymers may be used individually or if desired, as a blend of two or more thereof.

The image-forming layer for use in the present invention contains the above-described polymer latex in an amount of from 50 to 100 wt %, preferably 70 wt % or more, of the entire binder.

The image-forming layer for use in the present invention may contain a hydrophilic polymer, if desired, in an amount of 50 wt % or less, preferably 10 wt % or less, of the entire binder therein, such as gelatin, polyvinyl alcohol, methyl cellulose, hydroxypropyl cellulose, carboxymethyl cellulose and hydroxypropylmethyl cellulose. The amount of the hydrophilic polymer added is preferably 30 wt % or less, more preferably 5 wt % or less, of the entire binder in the image-forming layer.

The image-forming layer of the present invention is preferably formed by coating an aqueous coating solution and then drying it. The term "aqueous" as used herein means that 60 wt % or more of the solvent (dispersion medium) in the coating solution is water. The component other than water of the coating solution is a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, eater/methanol=70/30, water/ethanol=90/10, water/isopropanol=90/10, water-dimethylformamide=95/5, water/methanol/dimethylformamide=80/15/5 and water/methanol/dimethylformamide=90/5/5 (the numerals are in % by weight).

The entire binder amount in the image-forming layer for use in the present invention is preferably from 0.2 to 30 g/m$^2$, more preferably from 1 to 15 g/m$^2$. The image-forming layer for use in the present invention may contain a cross-linking agent for forming cross-linking and a surface active gent for improving the coatability.

The light-sensitive heat-developable image-forming material of the present invention contains a nucleating agent in a light-sensitive layer or another layer adjacent thereto so as to obtain a high-contrast image. Preferred examples of the nucleating agent for use in the present invention include substituted alkene derivatives, substituted isooxazole derivatives, specific acetal compounds and hydrazine derivatives.

The substituted alkene derivative, substituted isooxazole derivative and specific acetal compound represented by formula (1), formula (2) and formula (3), respectively, for use in the present invention are described below.

(1)

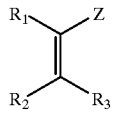

(2)

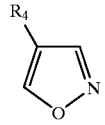

(3)

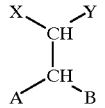

wherein in formula (1), $R_1$, $R_2$ and $R_3$ each independently represents a hydrogen atom or a substituent, Z represents an electron withdrawing group or a silyl group, and $R_1$ and Z, $R_2$ and $R_3$, $R_1$ and $R_2$ or $R_3$ and Z may be combined with each other to form a ring structure; in formula (2), $R_4$ represents a substituent; and in formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y or A and B may be combined with each other to form a ring structure.

The compound represented by formula (1) is described in detail below.

In formula (1), $R_1$, $R_2$ and $R_3$ each independently represents a hydrogen atom or a substituent, and Z represents an electron withdrawing group or a silyl group. In formula (1), $R_1$ and Z, $R_2$ and $R_3$, $R_1$ and $R_2$ or $R_3$ and Z may be combined with each other to form a ring structure.

When $R_1$, $R_2$ or $R_3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridino group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group (or a counter salt thereof), an alkoxy group (including a group containing an ethyleneoxy group or propyleneoxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxy or aryloxy) carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoylamino group, a nitro group, a mercapto group, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by the above-described substituent.

The electron withdrawing group represented by Z in formula (1) is a substituent having a Hammett's substituent constant op of a positive value and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group (or a salt thereof), a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group.

The electron withdrawing group represented by Z in formula (1) may further have a substituent and examples of the substituent include those described for the substituent which the substituent represented by $R_1$, $R_2$ or $R_3$ in formula (1) may have.

In formula (1), $R_1$ and Z, $R_2$ and $R_3$, $R_1$ and $R_2$ or $R_3$ and Z may be combined with each other to form a ring structure. The ring structure formed is a non-aromatic carbocyclic ring or a non-aromatic heterocyclic ring.

The preferred range of the compound represented by formula (1) is described below.

The silyl group represented by Z in formula (1) is preferably a trimethylsilyl group, a t-butyldimethylsilyl group, a phenyldimethylsilyl group, a triethylsilyl group, a triisopropylsilyl group or a trimethylsilyldimethylsilyl group.

The electron withdrawing group represented by Z in formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted by any electron withdrawing group, still more preferably a cyano group, a formyl group, an acyl group, an alkoxycarbonyl group, an imino group or a carbamoyl group.

The group represented by Z in formula (1) is preferably an electron withdrawing group.

The substituent represented by $R_1$, $R_2$ or $R_3$ in formula (1) is preferably a group having a total carbon atom number of from 0 to 30 and specific examples of the group include a group having the same meaning as the electron withdrawing group represented by Z in formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

In formula (1), $R_1$ is preferably an electron withdrawing group, an aryl group, an alkylthio group, an alkoxy group, an acylamino group, a hydrogen atom or a silyl group.

When $R_1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted by N atom, an alkylsulfonyl group, an arylsulfonyl group, a carbamoyl group, a sulfamoyl group, a trifluoromethyl group, a phosphoryl group, a carboxy group (or a salt thereof), a saturated or unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group (or a salt thereof) or a saturated or unsaturated heterocyclic group, still more preferably a cyano group, a formyl group, an acyl group, an alkoxycarbonyl group, a carbamoyl group or a saturated or unsaturated heterocyclic group.

When $R_1$ represents an aryl group, the aryl group is preferably a substituted or unsubstituted phenyl group having a total carbon atom number of from 6 to 30. The substituent may be any substituent but an electron withdrawing substituent is preferred.

In formula (1), $R_1$ is more preferably an electron withdrawing group or an aryl group.

The substituent represented by $R_2$ or $R_3$ in formula (1) is preferably a group having the same meaning as the electron withdrawing group represented by Z in formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

In formula (1), it is more preferred that one of $R_2$ and $R_3$ is a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, still more preferably a hydroxy group (or a salt thereof), an alkoxy group or a heterocyclic group.

In formula (1), it is also preferred that Z and $R_1$ or $R_2$ and $R_3$ form a ring structure. The ring structure formed is a non-aromatic carbocyclic ring or a non-aromatic heterocyclic ring, preferably a 5-, 6- or 7-membered ring structure having a total carbon atom number of from 1 to 40, more preferably from 3 to 30.

The compound represented by formula (1) is more preferably a compound where Z represents a cyano group, a formyl group, an acyl group, an alkoxycarbonyl group, an imino group or a carbamoyl group, $R_1$ represents an electron withdrawing group or an aryl group, and one of $R_2$ and $R_3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, more preferably a compound where Z and $R_1$ form a non-aromatic 5-, 6- or 7-membered ring structure and one of $R_2$ and $R_3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group. At this time, Z which forms a non-aromatic ring structure together with $R_1$ is preferably an acyl group, a carbamoyl group, an oxycarbonyl group, a thiocarbonyl group or a sulfonyl group and $R_1$ is preferably an acyl group, a carbamoyl group, an oxycarbonyl group, a thiocarbonyl group, a sulfonyl group, an imino group, an imino group substituted by N atom, an acylamino group or a carbonylthio group.

The compound represented by formula (2) is described below.

In formula (2), $R_4$ represents a substituent. Examples of the substituent represented by $R_4$ include those described for the substituent represented by $R_1$, $R_2$ or $R_3$ in formula (1).

The substituent represented by $R_4$ is preferably an electron withdrawing group or an aryl group. When $R_4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R_4$ represents an aryl group, the aryl group is preferably a substituted or unsubstituted phenyl group having a total carbon atom number of from 0 to 30. Examples of the substituent include those described for the substituent represented by $R_1$, $R_2$ or $R_3$ in formula (1).

$R_4$ is more preferably a cyano group, an alkoxycarbonyl group, a carbamoyl group, a heterocyclic group or a substituted or unsubstituted phenyl group, most preferably a cyano group, a heterocyclic group or an alkoxycarbonyl group.

The compound represented by formula (3) is described in detail below.

In formula (3), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B may be combined with each other to form a ring structure.

Examples of the substituent represented by X or Y in formula (3) include those described for the substituent represented by $R_1$, $R_2$ or $R_3$ in formula (1). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group (or a salt thereof), a sulfo group (or a salt thereof), a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group and a silyl group.

These groups each may further have a substituent. X and Y may be combined with each other to form a ring structure and the ring structure formed may be either a non-aromatic carbocyclic ring or a non-aromatic heterocyclic ring.

In formula (3), the substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In formula (3), X and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y for forming a ring structure each is preferably an acyl group, a carbamoyl group, an oxycarbonyl group, a thiocarbonyl group, a sulfonyl group, an imino group, an imino group substituted by N atom, an acylamino group or a carbonylthio group.

In formula (3), A and B each independently represents an alkoxy group, an alkylthio group, an alkylamino group, an aryloxy group, an arylthio group, an anilino group, a heterocyclic thio group, a heterocyclic oxy group or a heterocyclic amino group. A and B may be combined with each other to form a ring structure. The group represented by A or B in formula (3) is preferably a group having a total carbon atom number of from 1 to 40, more preferably from 1 to 30, and the group may further have a substituent.

In formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. Examples of the linkage (—A—B) formed by A and B include —O—$(CH_2)_2$—O—, —O—$(CH_2)_3$—O—, —S—$(CH_2)_2$—S—, —S—$(CH_2)_3$—S—, —S—ph—S—, —N($CH_3$)—$(CH_2)_2$—O—, —N($CH_3$)—$(CH_2)_2$—S—, —O—$(CH_2)_2$—S—, —O—$(CH_2)_3$—S—, —N($CH_3$) -ph-O—, —N($CH_3$)-ph-S— and —N(ph)—$(CH_2)_2$—S—.

Into the compound represented by formula (1), (2) or (3) for use in the present invention, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

Into the compound represented by formula (1), (2) or (3) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by formula (1), (2) or (3) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent 4,006,032.

Specific examples of the compounds represented by formulae (1) to (3) for use in the present invention are shown below, however, the present invention is by no means limited to the following compounds.

C-1

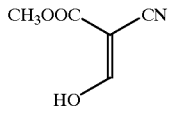

C-2

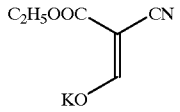

C-3

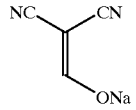

C-4

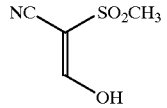

C-5

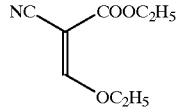

C-6

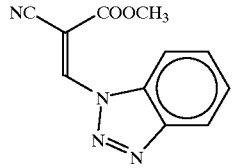

C-7

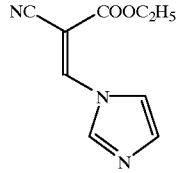

C-8

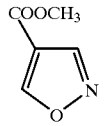

C-9

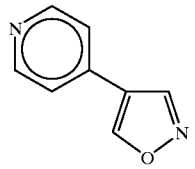

C-10

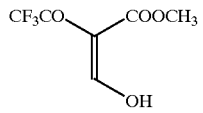

C-11

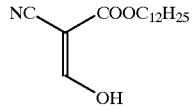

-continued
C-12
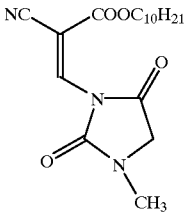
C-13
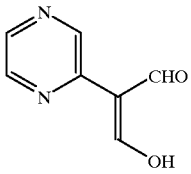
C-14
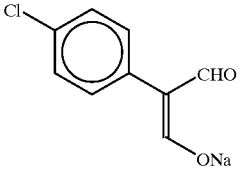
C-15
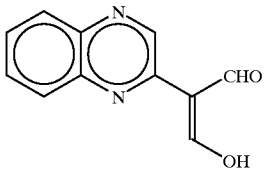
C-16
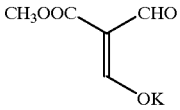
C-17
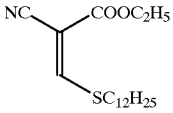
C-18
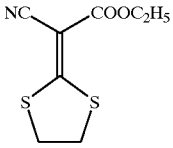
C-19
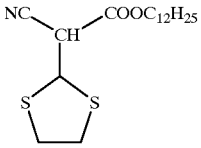
C-20
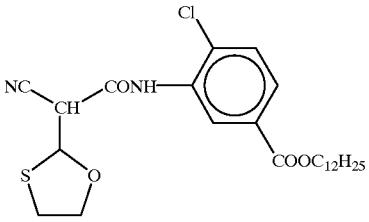
-continued
C-21
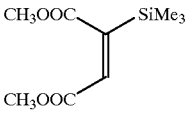
C-22
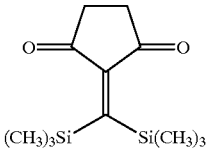
C-23
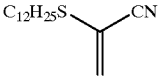
C-24
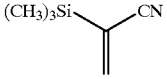
C-25
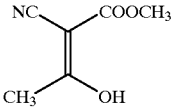
C-26
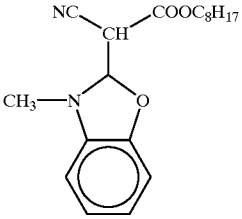
C-27
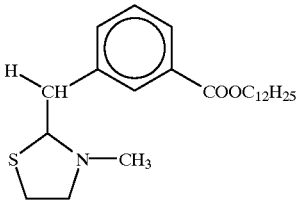
C-28
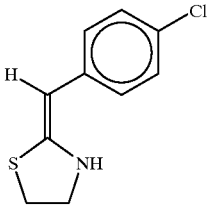
C-29
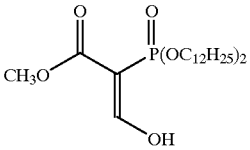
C-30
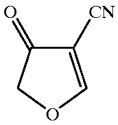

-continued
C-31
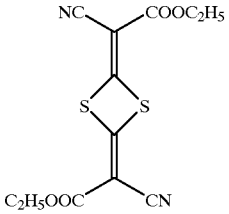
C-32
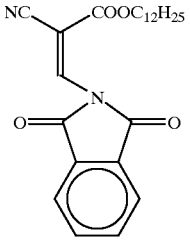
C-33
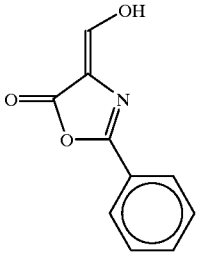
C-34
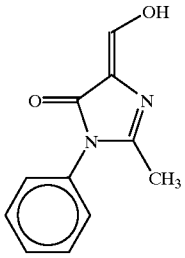
C-35
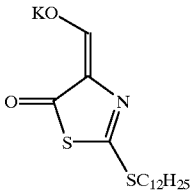
C-36
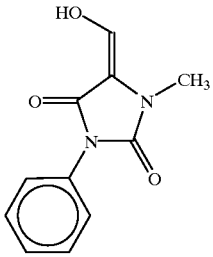
-continued
C-37
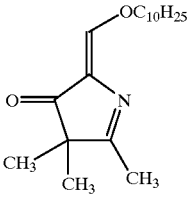
C-38
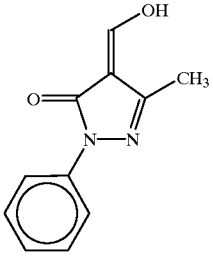
C-39
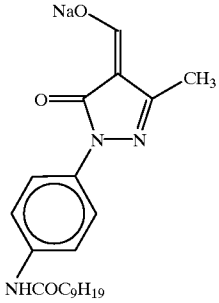
C-40
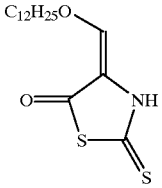
C-41
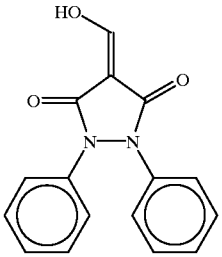
C-42
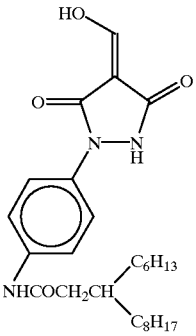

-continued
C-43
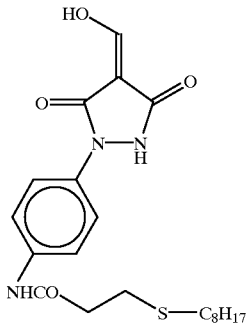
C-44
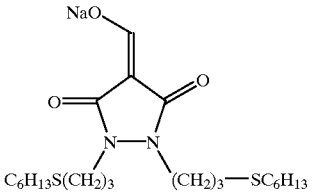
C-45
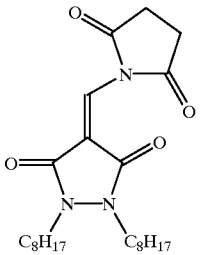
C-46
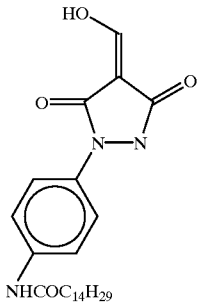
C-47
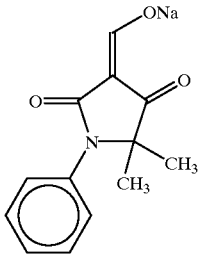
-continued
C-48
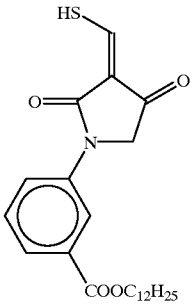
C-49
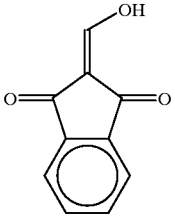
C-50
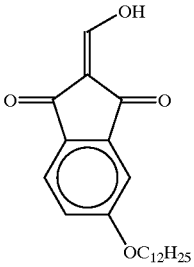
C-51
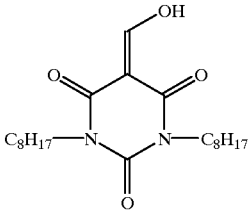
C-52
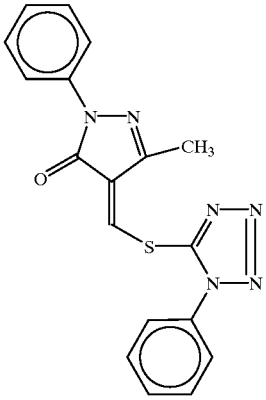

-continued

C-53

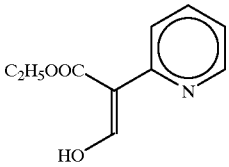

C-54

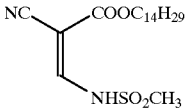

C-55

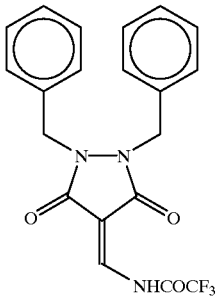

C-56

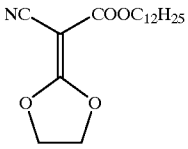

C-57

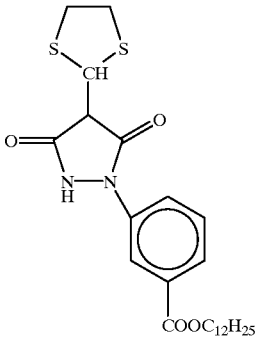

C-58

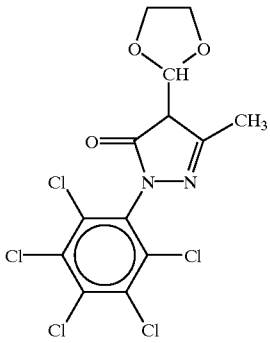

-continued

C-59

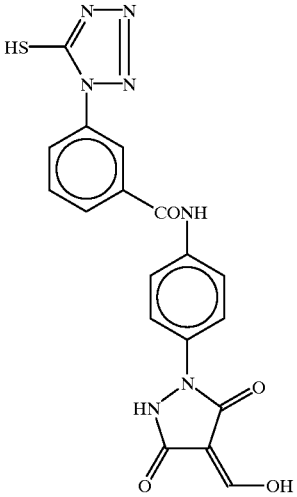

C-60

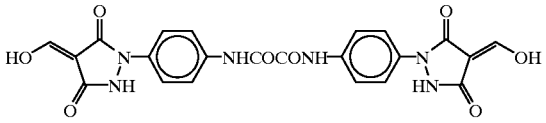

The compounds represented by formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds represented by formulae (1) to (3) for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by formulae (1) to (3) each may be used after dispersing the powder of the compound in an appropriate solvent such as water by a method known as a solid dispersion method, using a ball mill, a colloid mill or an ultrasonic wave.

The compounds represented by formulae (1) to (3) for use in the present invention each may be added to a layer in the image-recording layer side on the support, namely, an image-forming layer, or any other layers, however, the compounds each is preferably added to an image-forming layer or a layer adjacent thereto.

The addition amount of the compound represented by formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

The compounds represented by formulae (1) to (3) can be easily synthesized according to known methods and may be synthesized by referring, for example, to U.S. Pat. Nos. 5,545,515, 5,635,339 and 5,654,130, International Patent WO97/34196 or Japanese Patent Application Nos. 9-309813 and 9-272002.

The compounds represented by formulae (1) to (3) may be used individually or in combination of two or more thereof. In addition to these compounds, a compound described in U.S. Pat. Nos. 5,545,515, 5,635,339 and 5,654,130, International Patent WO97/34196, U.S. Pat. No. 5,686,228 or Japanese Patent Application Nos. 8-279962, 9-228881, 9-273935, 9-309813, 9-296174, 9-282564, 9-272002, 9-272003 and 9-332388 may also be used in combination.

In the present invention, a hydrazine derivative described below may be used as the nucleating agent. Furthermore, the hydrazine derivative nucleating agent may be used in combination with the foregoing nucleating agent.

The hydrazine derivative for use in the present invention is preferably a compound represented by the following formula (H):

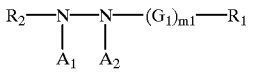

(H)

wherein $R_2$ represents an aliphatic group, an aromatic group or a heterocyclic group, $R_1$ represents a hydrogen atom or a block group, $G_1$ represents —CO—, —COCO—, —C═S—, —$SO_2$—, —SO—, —PO($R_3$)— (wherein $R_3$ is a group selected from the groups within the range defined for $R_1$ and $R_3$ may be different from $R_1$), a thiocarbonyl group or an iminomethylene group, $A_1$ and $A_2$ both represents a hydrogen atom or one represents a hydrogen atom and the other represents a substituted or unsubstituted alkylsulfonyl group, a substituted or unsubstituted arylsulfonyl group, or a substituted or unsubstituted acyl group, and $m_1$ represents 0 or 1 and when $m_1$ is 0, $R_1$ represents an aliphatic group, an aromatic group or a heterocyclic group.

In formula (H), the aliphatic group represented by $R_2$ is preferably a substituted or unsubstituted, linear, branched or cyclic alkyl group having from 1 to 30 carbon atoms, an alkenyl group or an alkynyl group.

In formula (H), the aromatic group represented by $R_2$ is a monocyclic or condensed cyclic aryl group and examples thereof include a benzene ring and a naphthalene ring. The heterocyclic group represented by $R_2$ is a monocyclic or condensed cyclic, saturated or unsaturated, aromatic or non-aromatic heterocyclic group and examples thereof include a pyridine ring, a pyrimidine ring, an imidazole ring, a pyrazole ring, a quinoline ring, an isoquinoline ring, a benzimidazole ring, a thiazole ring, a benzothiazole ring, a piperidine ring, a triazine ring, a morpholino ring, a piperidine ring and a piperazine ring.

$R_2$ is preferably an aryl group or an alkyl group.

$R_2$ may be substituted and representative examples of the substituent include a halogen atom (e.g., fluorine, chlorine, bromine, iodine), an alkyl group (including an aralkyl group, a cycloalkyl group and an active methine group), an alkenyl group, an alkynyl group, an aryl group, a heterocyclic group, a heterocyclic group containing a quaternized nitrogen atom (e.g., pyridinio), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or a propylene oxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, a N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazide group, thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl) sulfonyl group, an (alkyl or arylsulfinyl group, a sulfo group or a salt thereof, a sulfamoyl group, an acylsulfamoyl group, a sulfonylsulfamoyl group or a salt thereof, and a group containing a phosphoramido or phosphoric acid ester structure.

These substituents each may further be substituted by the above-described substituent.

When $R_2$ represents an aromatic group or a heterocyclic group, the substituent of $R_2$ is preferably an alkyl group (including an active methylene group), an aralkyl group, a heterocyclic group, a substituted amino group, an acylamino group, a sulfonamide group, a ureido group, a sulfamoylamino group, an imido group, a thioureido group, a phosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic)thio group, a sulfo group (including a salt thereof), a sulfamoyl group, a halogen atom, a cyano group or a nitro group.

When $R_2$ represents an aliphatic group, the substituent is preferably an alkyl group, an aryl group, a heterocyclic group, an amino group, an acylamino group, a sulfonamido group, a ureido group, a sulfamoylamino group, an imido group, a thioureido group, a phosphoramido group, a hydroxy group, an alkoxy group, an aryloxy group an acyloxy group, an acyl group, an alkoxycarbonyl group, an aryloxycarbonyl group, a carbamoyl group, a carboxy group (including a salt thereof), an (alkyl, aryl or heterocyclic)thio group, a sulfo group (including a salt thereof), a sulfamoyl group, a halogen atom, a cyano group or a nitro group.

In formula (H), $R_1$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R_1$ is preferably a substituted or unsubstituted alkyl group having from 1 to 10 carbon atoms and examples thereof include a methyl group, an ethyl group, a trifluoromethyl group, a difluoromethyl group, a 2-carboxytetrafluoroethyl group, a pyridinomethyl group, a difluoromethoxymethyl group, a difluorocarboxymethyl group, a 3-hydroxypropyl group, a 3-methanesulfonamidopropyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group. The alkenyl group is preferably an alkenyl group having from 1 to 10 carbon atoms and examples thereof include a vinyl group, a 2-ethoxycarbonylvinyl group and a 2-trifluoro-2-methoxycarbonylvinyl group. The alkynyl group is an alkynyl group having from 1 to 10 carbon atoms and examples thereof include an ethynyl group and a 2-methoxycarbonylethynyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group.

The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group (e.g., N-methyl-3-pyridinio group), a quinolinio group and a quinolyl group.

The alkoxy group is preferably an alkoxy group having from 1 to 8 carbon atoms and examples thereof include a methoxy group, a 2-hydroxyethoxy group, a benzyloxy group and a t-butoxy group. The aryloxy group is preferably a substituted or unsubstituted phenoxy group and the amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, an anilino group, an o-hydroxyanilino group, a 5-benzotriazolylamino group and a N-benzyl-3-pyridinioamino group. The hydrazino group is preferably a substituted or unsubstituted hydrazino group or a substituted or unsubstituted phenylhydrazino group (e.g., 4-benzenesulfonamidophenylhydrazino group).

The group represented by $R_1$ may be substituted and examples of the substituent include those described as the substituent of $R_2$.

In formula (H), $R_1$ may be one which cleaves the $G_1$—$R_1$ moiety from the residual molecule and causes a cyclization reaction to form a cyclic structure containing the atoms in the —$G_1$—$R_1$ moiety, and examples thereof include those described in JP-A-63-29751.

Into the hydrazine derivative represented by formula (H), an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

In formula (H), $R_1$ or $R_2$ may be one into which a ballast group or polymer commonly used in immobile photographic additives such as a coupler may be integrated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

In formula (H), $R_1$ or $R_2$ may contain a plurality of hydrazino groups as the substituent. At this time, the compound represented by formula (H) is a polymer product with respect to the hydrazino group and specific examples thereof include the compounds described in JP-A-64-86134, JP-A-4-16938, JP-A-5-197091, WO95-32452, WO95-32453, Japanese Patent Application Nos. 7-351132, 7-351269, 7-351168, 7-351287 and 9-179229.

In formula (H), $R_1$ or $R_2$ may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic)thio group, or a dissociative group capable of dissociation by a base (e.g., carboxy group, sulfo group, acylsulfamoyl group, carbamoylsulfamoyl group). Examples of the compound containing such a group include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent 4,006,032.

In formula (H), $A_1$ and $A_2$ each represents a hydrogen atom, an alkyl- or arylsulfonyl group having 20 or less carbon atoms (preferably a phenylsulfonyl group or a phenylsulfonyl group substituted such that the sum of Hammett's substituent constants is −0.5 or more), an acyl group having 20 or less carbon atoms (preferably a benzoyl group, a benzoyl group substituted such that the sum of Hammett's substituent constants is −0.5 or more, or a linear, branched or cyclic, substituted or unsubstituted aliphatic acyl group (examples of the substituent include a halogen atom, an ether group, a sulfonamido group, a carbonamido group, a hydroxy group, a carboxy group and a sulfo group)).

$A_1$ and $A_2$ each is most preferably a hydrogen atom.

A particularly preferred embodiment of the hydrazine derivative for use in the present invention is described below.

$R_2$ is preferably a phenyl group or a substituted alkyl group having from 1 to 3 carbon atoms.

When $R_2$ represents a phenyl group, the substituent therefor is preferably a nitro group, an alkoxy group, an alkyl group, an acylamino group, a ureido group, a sulfonamido group, a thioureido group, a carbamoyl group, a sulfamoyl group, a carboxy group (or a salt thereof), a sulfo group (or a salt thereof), an alkoxycarbonyl group or a chlorine atom.

When $R_2$ represents a substituted phenyl group, the substituted is preferably substituted directly or through a linking group by at least one of a ballast group, an adsorptive group to silver halide, a group containing a quaternary ammonio group, a nitrogen-containing heterocyclic group containing a quaternized nitrogen, a group containing an ethleneoxy group as a repeating unit, an (alkyl, aryl or heterocyclic)thio group, a nitro group, an alkoxy group, an acylamino group, a sulfonamido group, a dissociative group (e.g., carboxy group, sulfo group, acylsulfamoyl group, carbamoylsulfamoyl group) and a hydrazino group capable of forming a polymer product (a group represented by —NHNH—$G_1$—$R_1$).

When $R_2$ represents a substituted alkyl group having from 1 to 3 carbon atoms, $R_2$ is more preferably a substituted methyl group, more preferably a disubstituted or trisubstituted methyl group, and the substituent therefor is preferably a methyl group, a phenyl group, a cyano group, an (alkyl, aryl or heterocyclic)thio group, an alkoxy group, an aryloxy group, a chlorine atom, a heterocyclic group, an alkoxycarbonyl group, an aryloxycarbonyl group, a carbamoyl group, a sulfamoyl group, an amino group, an acylamino group or a sulfonamido group, more preferably a substituted or unsubstituted phenyl group.

When $R_2$ represents a substituted methyl group, $R_2$ is preferably a t-butyl group, a dicyanomethyl group, a dicyanophenylmethyl group, a triphenylmethyl group (trityl group), a diphenylmethyl group, a methoxycarbonyldiphenylmethyl group, a cyanodiphenylmethyl group, a methylthiodiphenylmethyl group or a cyclopropyldiphenylmethyl group, most preferably a trityl group.

In formula (H), $R_2$ is most preferably a substituted phenyl group.

In formula (H), $m_2$ represents 1 or 0. When $m_1$ is 0, $R_1$ is an aliphatic group, an aromatic group or a heterocyclic group, preferably a phenyl group or a substituted alkyl group having from 1 to 3 carbon atoms, and these groups have the same preferred range as described above for $R_2$.

$m_1$ is preferably 1.

The preferred embodiment of the group represented by $R_1$ is described below. When $R_2$ is a phenyl group and $G_1$ is —CO—, $R_1$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R_1$ represents an alkyl group, the substituent therefor is preferably a halogen atom, an alkoxy group, an aryloxy group, an alkylthio group, an arylthio group or a carboxy group.

When $R_2$ is a substituted methyl group and $G_1$ is —CO—, $R_1$ is preferably a hydrogen atom, an alkyl group, an aryl group, a heterocyclic group, an alkoxy group or an amino group (e.g., unsubstituted amino group, alkylamino group, arylamino group, heterocyclic amino group), more preferably a hydrogen atom, an alkyl group, an aryl group, a heterocyclic group, an alkoxy group, an alkylamino group, an arylamino group or a heterocyclic amino group.

When $G_1$ is —COCO—, $R_1$ is preferably, irrespective of $R_2$, an alkoxy group, an aryloxy group or an amino group, more preferably a substituted amino group, specifically, an alkylamino group, an arylamino group or a saturated or unsaturated heterocyclic amino group.

When $G_1$ is $—SO_2—$, $R_1$ is preferably, irrespective of $R_2$, an alkyl group, an aryl group or a substituted amino group.

In formula (H), $G_1$ is preferably —CO— or —COCO—, more preferably —CO—.

Specific examples of the compound represented by formula (H) are shown below, however, the present invention is by no means limited to those compounds.

In addition to the above-described hydrazine derivative, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

Examples of the hydrazine derivative other than the hydrazine derivative described in the foregoing include the compound represented by (Chem. 1) of JP-B-6-77138, specifically, compounds described at pages 3 and 4 of the publication; the compound represented by formula (I) of JP-B-6-93082, specifically, compounds described at pages 8 to 18 of the publication; the compounds represented by formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by formulae (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, compounds described at pages 3 to 5 of the publication; the compound represented by formula (I) of JP-A-7-5610, specifically, Compounds I-1 to I-38 described at pages 5 to 10 of the publication; the compound represented by formula (II) of JP-A-7-77783, specifically, Compounds II-1 to II-102 described at pages 10 to 27 of the publication; the compounds represented by formulae (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an internal hydrogen bond with the hydrogen atom of the hydrazine, described in JP-A-9-22082, particularly, the compounds represented by formulae (A), (B), (C), (D), (E) and (F), specifically, Compounds N-1 to N-30; the compound represented by formula (1) described in Japanese Patent Application No. 7-191007, specifically, Compounds D-1 to D-55; various hydrazine derivatives described at pages 25 to 34 of *Kochi Gijutsu* (*Known Techniques*), pages 1 to 207, Aztech (issued on Mar. 22, 1991); and Compounds D-2 and D-39 described in JP-A-62-86354 (pages 6 and 7).

TABLE 1

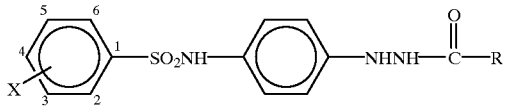

| | | R = | | | |
|---|---|---|---|---|---|
| | X = | —H | $C_2F_4$—COOH (or —$C_2F_4$—$COO^{\ominus}K^{\oplus}$) | 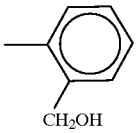 | 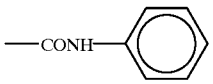 |
| 1 | 3-NHCO—$C_9H_{19}$(n) | 1a | 1b | 1c | 1d |
| 2 | 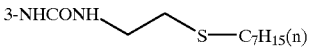 | 2a | 2b | 2c | 2d |
| 3 | 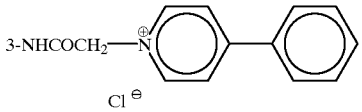 | 3a | 3b | 3c | 3d |

TABLE 1-continued
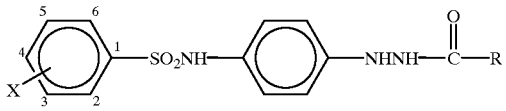
| | X = | R = —H | $C_2F_4$—COOH (or —$C_2F_4$—$COO^{\ominus}K^{\oplus}$) | 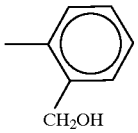 | 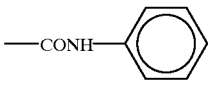 |
|---|---|---|---|---|---|
| 4 | 3-$NHCOCH_2$—$N^{\oplus}(CH_3)_2$—$C_8H_{17}$ $Cl^{\ominus}$ | 4a | 4b | 4c | 4d |
| 5 | 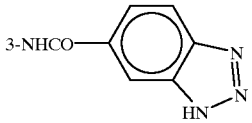 | 5a | 5b | 5c | 5d |
| 6 | 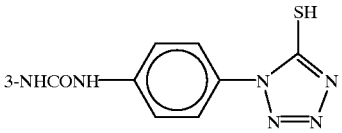 | 6a | 6b | 6c | 6d |
| 7 | 2,4-$(CH_3)_2$— 3-$SC_2H_4$—$(OC_2H_4)_4$—$OC_8H_{17}$ | 7a | 7b | 7c | 7d |
TABLE 2
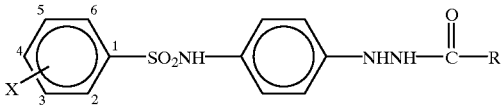
| | X = | R = —H | —$CF_2H$ | 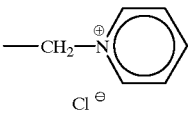 | 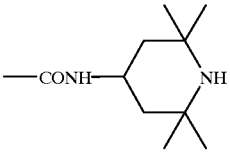 |
|---|---|---|---|---|---|
| 8 | 3-$CONHCH_2CH(C_2H_5)$—$C_4H_9$ | 8a | 8e | 8f | 8g |
| 9 | 6-$OCH_3$-3-$C_5H_{11}$(t) | 9a | 9e | 9f | 9g |
| 10 | 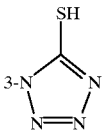 | 10a | 10e | 10f | 10g |

TABLE 2-continued
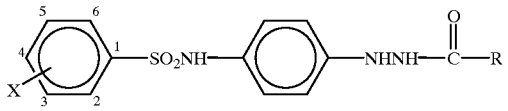
| | | R = | | | |
|---|---|---|---|---|---|
| X = | | —H | —$CF_2H$ | 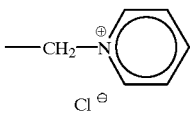 | 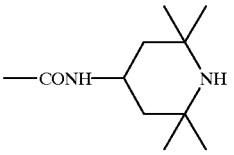 |
| 11 | 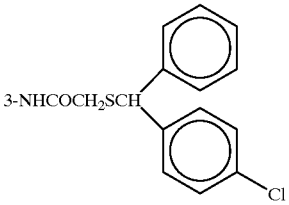 | 11a | 11e | 11f | 11g |
| 12 | 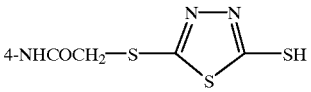 | 12a | 12e | 12f | 12g |
| 13 | 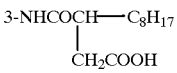 | 13a | 13e | 13f | 13g |
| 14 | 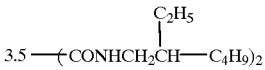 | 14a | 14e | 14f | 14g |
TABLE 3
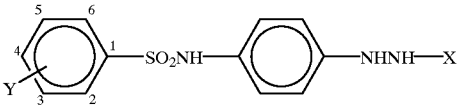
| | | X = | | | |
|---|---|---|---|---|---|
| Y = | | —CHO | —$COCF_3$ | —$SO_2CH_3$ | —$P(OC_2H_5)_2$ |
| 15 | 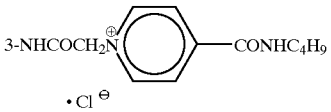 | 15a | 15h | 15i | 15j |
| 16 | 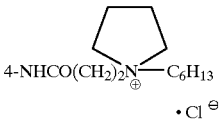 | 16a | 16h | 16i | 16j |

TABLE 3-continued
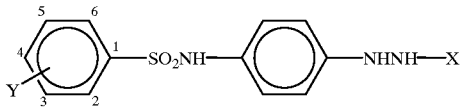
| | Y = | X = —CHO | —$COCF_3$ | —$SO_2CH_3$ | —$P(OC_2H_5)_2$ |
|---|---|---|---|---|---|
| 17 | 3-$SO_2NH$ 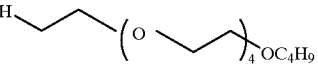 | 17a | 17h | 17i | 17j |
| 18 | 3.4-$(COOCH(CH_3)COOC_4H_9)_2$ | 18a | 18h | 18i | 18j |
| 19 | 3-NHCO 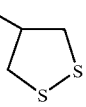 | 19a | 19h | 19i | 19j |
| 20 | 3-$NHSO_2NH$—$C_8H_{17}$ | 20a | 20h | 20i | 20j |
| 21 | 2-Cl-5- 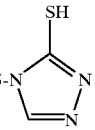 | 21a | 21h | 21i | 21j |
TABLE 4
| | | R = —H | —$CF_3$ | 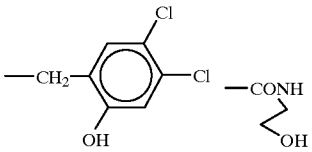 |  |
|---|---|---|---|---|---|
| 22 | 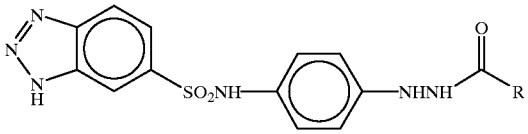 | 22a | 22h | 22k | 22l |
| 23 | 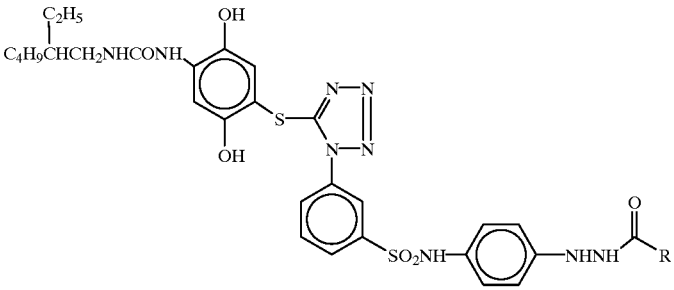 | 23a | 23h | 23k | 23l |

TABLE 4-continued
| | | R = | | | |
|---|---|---|---|---|---|
| | | —H | —$CF_3$ | 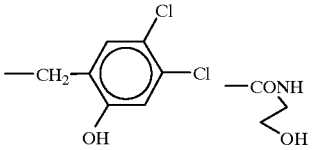 |  |
| 24 | 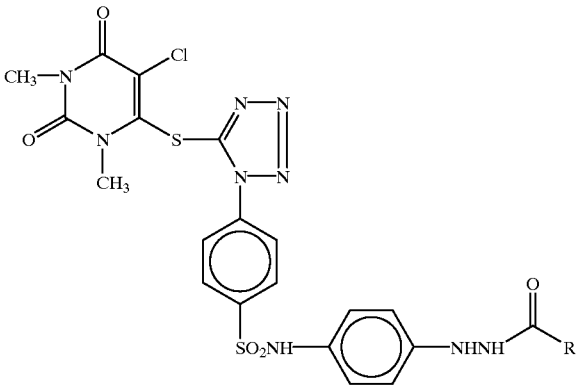 | 24a | 24h | 24k | 24l |
| 25 | 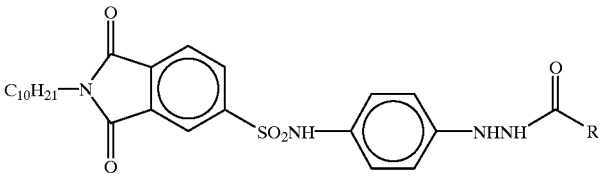 | 25a | 25h | 25k | 25l |
TABLE 5
| | | | | | |
|---|---|---|---|---|---|
| 26 | 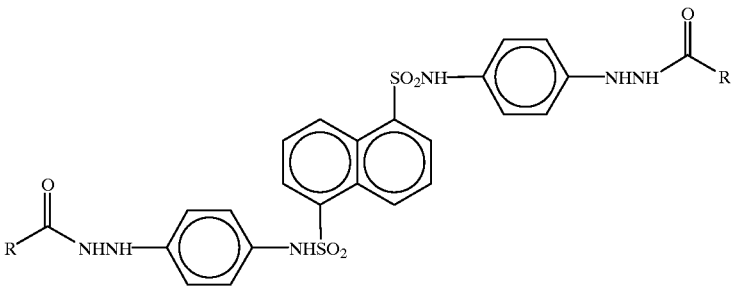 | 26a | 26h | 26k | 26l |
| 27 | 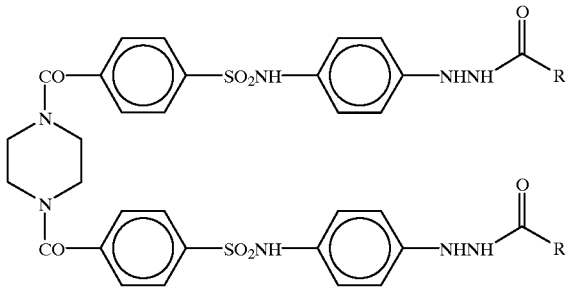 | 27a | 27h | 27k | 27l |

TABLE 5-continued
| | | | | | |
|---|---|---|---|---|---|
| 28 | 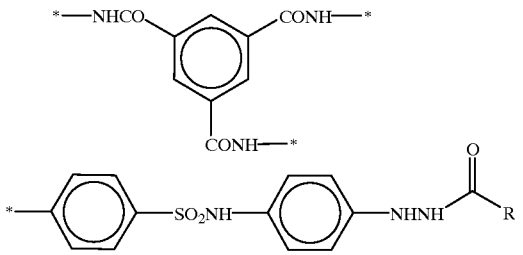 | 28a | 28h | 28k | 28l |
TABLE 6
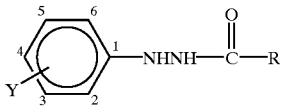
| | | R = | | | |
|---|---|---|---|---|---|
| | Y = | —H | —$CH_2OCH_3$ | 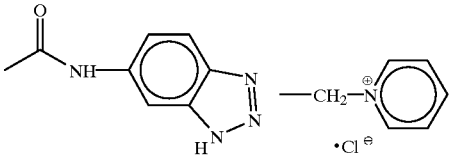 | |
| 29 | 4-NHCNH—$C_8H_{17}$(n) (S) | 29a | 29m | 29n | 29f |
| 30 | 4-NHP(OCH$_2$—⟨⟩)$_2$ (S) | 30a | 30m | 30n | 30f |
| 31 | 4-NHCONH—$(CH_2)_3O$—⟨⟩ | 31a | 31m | 31n | 31f |
| 32 | 4-OH<br>3-NHCONHCH$_2$CH($C_2H_5$)—$C_4H_9$ | 32a | 32m | 32n | 32f |
| 33 | 4-NHSO$_2$(CH$_2$)$_2$NHCO—⟨⟩ (SH, N, N, N, N) | 33a | 33m | 33n | 33f |
| 34 | 4-OCH$_2$—⟨⟩ | 34a | 34m | 34n | 34f |

TABLE 6-continued
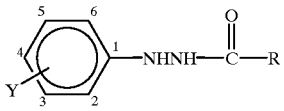
| Y = | R = —H | —$CH_2OCH_3$ | 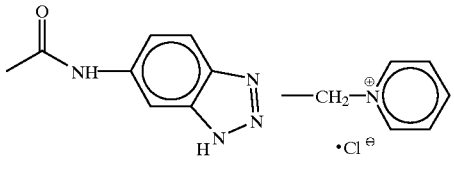 | |
|---|---|---|---|---|
| 35 4-NHCONHN—($CH_2$—)$_2$ | 35a | 35m | 35n | 35f |
TABLE 7
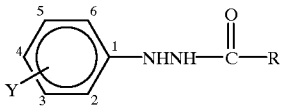
| Y = | R = —H | —$CF_2SCH_3$ | —$CONHCH_3$ | 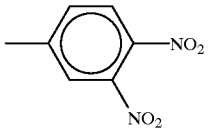 |
|---|---|---|---|---|
| 36 2-$NHSO_2CH_3$— 4-NHCONH$(CH_2)_3$S— 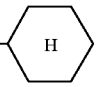 | 36a | 36o | 36p | 36q |
| 37 2-$OCH_3$— 4-$NHSO_2C_{12}H_{25}$ | 37a | 37o | 37p | 37q |
| 38 3-$NHCOC_{11}H_{23}$— 4-$NHSO_2CF_3$ | 38a | 38o | 38p | 38q |
| 39 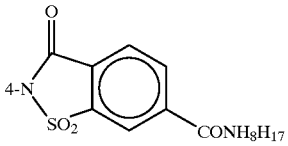 | 39a | 39o | 39p | 39q |
| 40 4-$OCO(CH_2)_2COOC_5H_{13}$ | 40a | 40o | 40p | 40q |
| 41 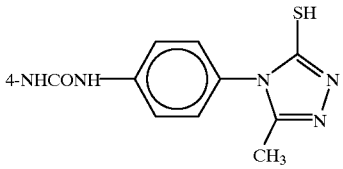 | 41a | 41o | 41p | 41q |

TABLE 7-continued
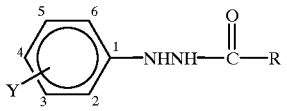
| Y = | | R = —H | —$CF_2SCH_3$ | —$CONHCH_3$ | 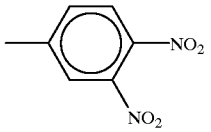 |
|---|---|---|---|---|---|
| 42 | 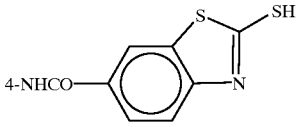 | 42a | 42o | 42p | 42q |
TABLE 8
43
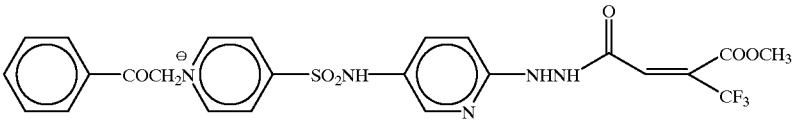
44
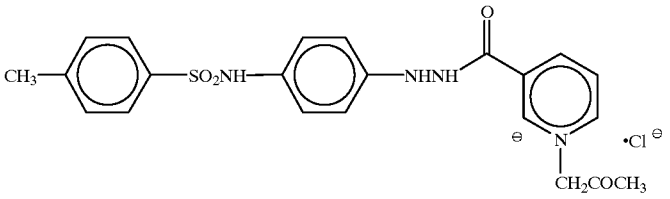
45
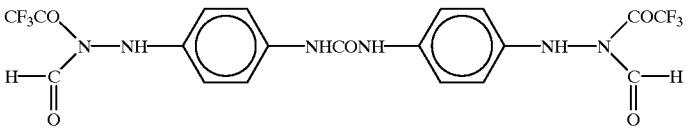
46
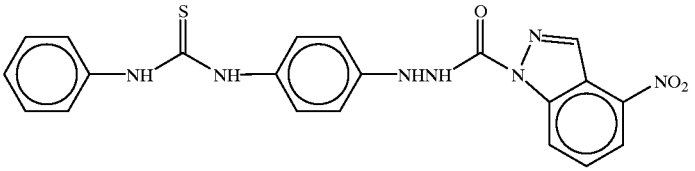
47
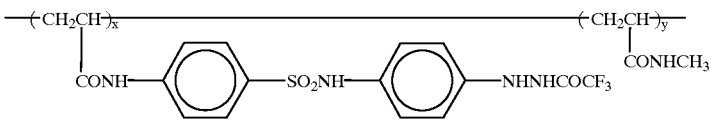

TABLE 8-continued
48
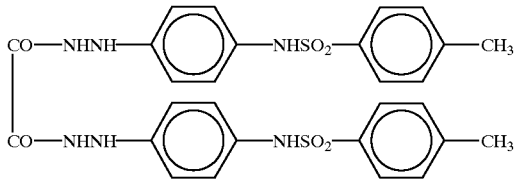
49
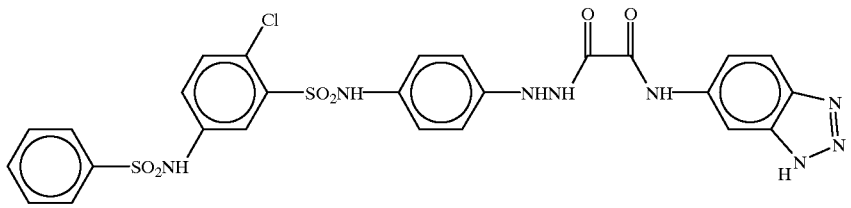
50
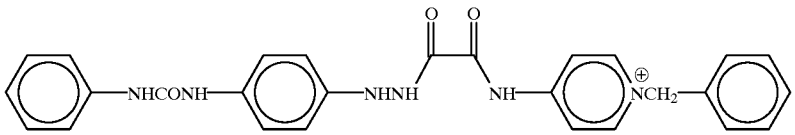
In Compound No. 47, x:y is 3:97 and the average molecular weight thereof is about 100,000
TABLE 9
51
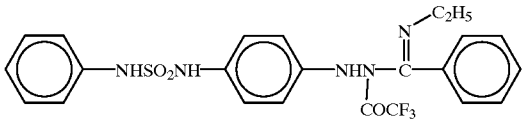
52
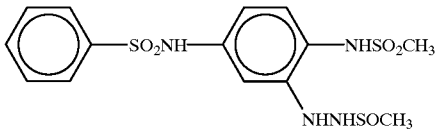
53
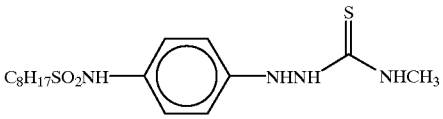

TABLE 10
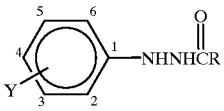
| | Y = | R = —H | —$CH_2OCH_3$ | —$CH_2O$— 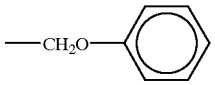 | —$CONHC_3H_7$ |
|---|---|---|---|---|---|
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 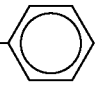 | 58a | 58m | 58r | 58s |
| 59 | 4-NHC(O)N(—$CH_2$— 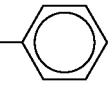 )(—$CH_2$— 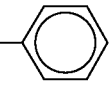 ) | 59a | 59m | 59r | 59s |
TABLE 11
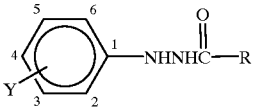
| | Y= | R= —H | 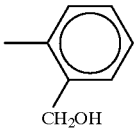 | —$CH_2$— 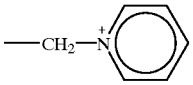 | —CONH— 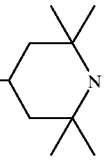 |
|---|---|---|---|---|---|
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |
| 64 | 4-NHCO— 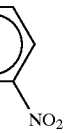 | 64a | 64c | 64f | 64g |

TABLE 11-continued
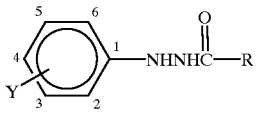
| | R= | | | |
|---|---|---|---|---|
| Y= | —H | 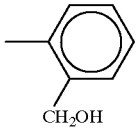 | 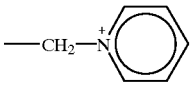 | 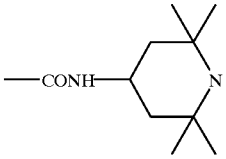 |
| 65 | 65a | 65c | 65f | 65g |
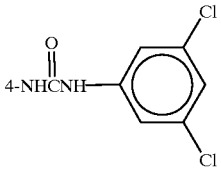
TABLE 12
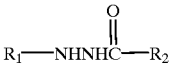
| | $R_2$ = | | | |
|---|---|---|---|---|
| $R_1$ = | —H | 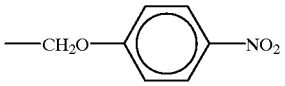 | 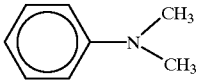 | 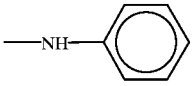 |
| 66 | 66a | 66u | 66v | 66t |
| 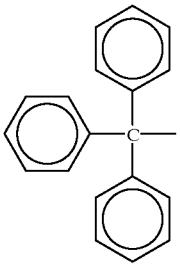 | | | | |
| 67 | 67a | 67u | 67v | 67t |
| 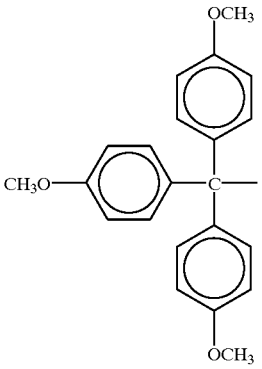 | | | | |

TABLE 12-continued
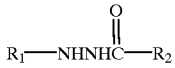
| $R_1$ = | $R_2$ = —H | —$CH_2O$— 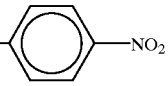 —$NO_2$ | 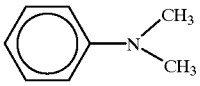 | —NH— 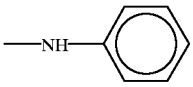 |
|---|---|---|---|---|
| 68 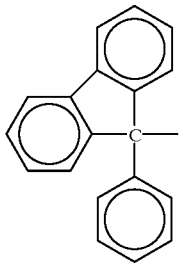 | 68a | 68u | 68v | 68t |
| 69 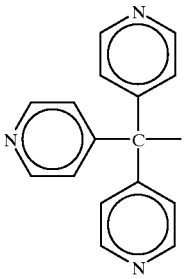 | 69a | 69u | 69v | 69t |
| 70 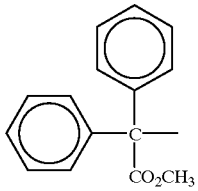 | 70a | 70u | 70v | 70t |
| 71 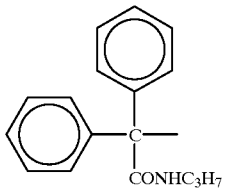 | 71a | 71u | 71v | 71t |

TABLE 13
| | $R_1$—NHNHC(=O)—$R_2$ | | | |
|---|---|---|---|---|
| | $R_2$ = | | | |
| $R_1$ = | —C(=O)NHC$_3$H$_7$ | —C(=O)O—C$_4$H$_9$(t) | —OC$_4$H$_9$(t) | 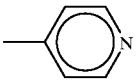 |
| 72 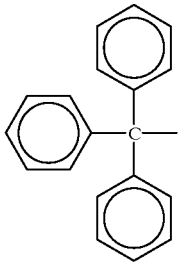 | 72s | 72x | 72y | 72w |
| 73 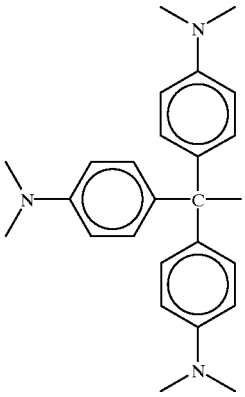 | 73s | 73x | 73y | 73w |
| 74 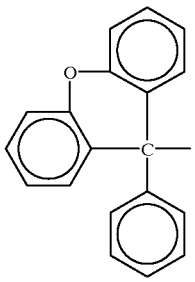 | 74s | 74x | 74y | 74w |
| 75 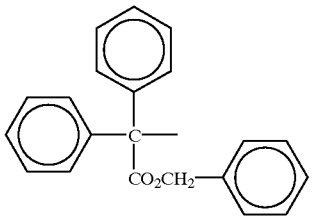 | 75s | 75x | 75y | 75w |

TABLE 13-continued
| | $R_1$—NHNHC(=O)—$R_2$ | | | |
|---|---|---|---|---|
| | $R_2$ = | | | |
| $R_1$ = | —CNHC$_3$H$_7$ (=O) | —CO—C$_4$H$_9$(t) (=O) | —OC$_4$H$_9$(t) | 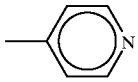 |
| 76 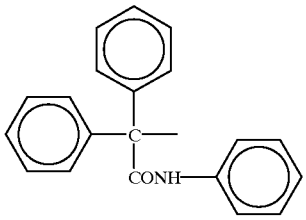 | 76s | 76x | 76y | 76w |
TABLE 14
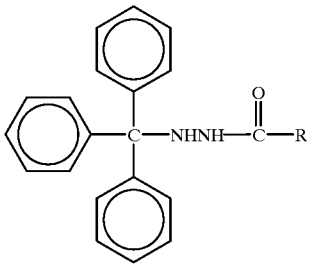
R =
| | |
|---|---|
| 77 | 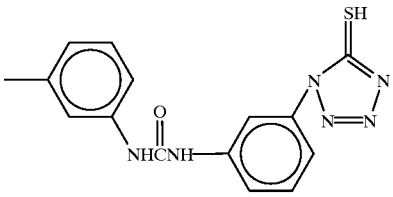 |
| 78 | 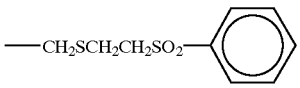 |
| 79 | —$CH_2OCH_2CH_2SCH_2CH_2OCH_3$ |
| 80 | —$CF_2CF_2COOH$ |
| 81 | 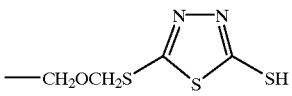 |
| 82 | 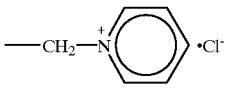 |
TABLE 15
| | |
|---|---|
| 83 | 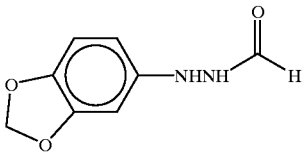 |
| 84 | 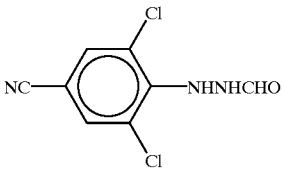 |
| 85 | 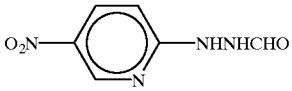 |
| 86 | 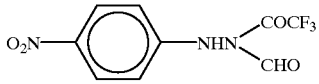 |
| 87 | 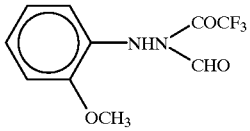 |
| 88 | 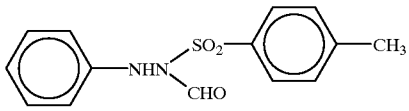 |

TABLE 16
| | |
|---|---|
| 89 | 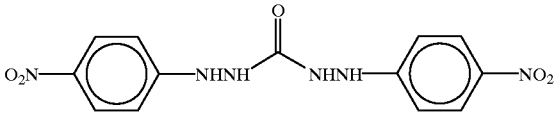 |
| 90 | 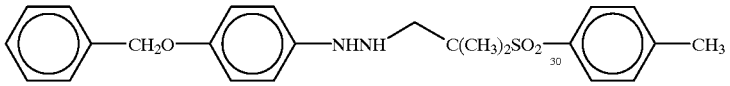 |
| 91 | 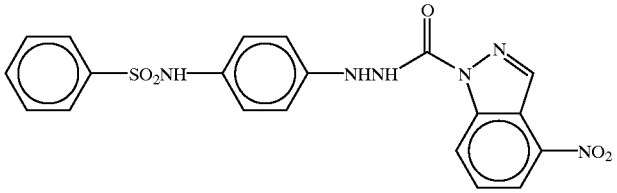 |
| 92 | 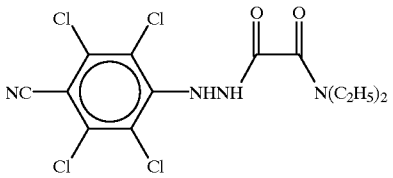 |
| 93 | 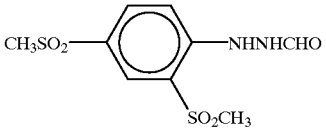 |
| 94 | 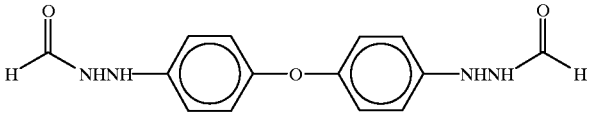 |
TABLE 17
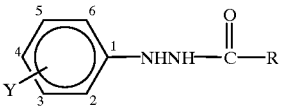
| | Y = | R = 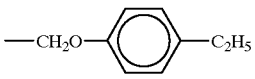 | 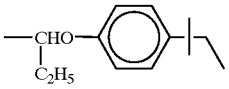 | 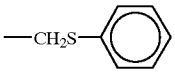 | $—CH_2—Cl$ |
|---|---|---|---|---|---|
| 95 | 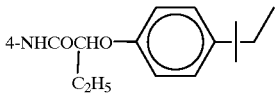 | 95-1 | 95-2 | 95-3 | 95-4 |
| 96 | 4-COOH | 96-1 | 96-2 | 96-3 | 96-4 |

TABLE 17-continued
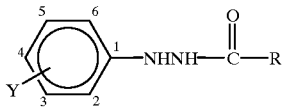
| | Y = | R = | | | |
|---|---|---|---|---|---|
| | | 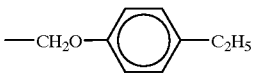 | 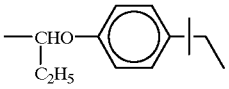 | 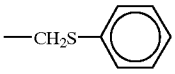 | —$CH_2$—Cl |
| 97 | 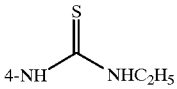 | 97-1 | 97-2 | 97-3 | 97-4 |
| 98 | 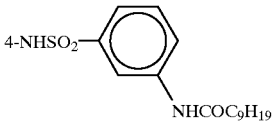 | 98-1 | 98-2 | 98-3 | 98-4 |
| 99 | 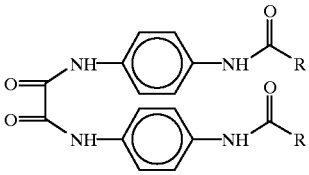 | 99-1 | 99-2 | 99-3 | 99-4 |
| 100 | 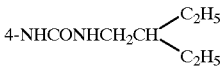 | 100-1 | 100-2 | 100-3 | 100-4 |

TABLE 18
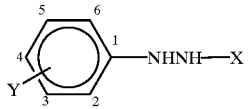
| | | X = | | | |
|---|---|---|---|---|---|
| | Y = | 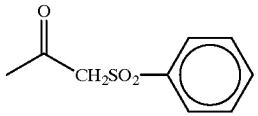 | 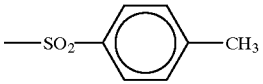 | 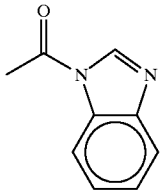 | 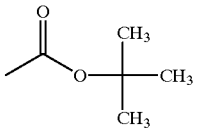 |
| 101 | 4-$NO_2$ | 101-5 | 101-6 | 101-7 | 101y |
| 102 | 2,4-$OCH_3$ | 102-5 | 102-6 | 102-7 | 102y |
| 103 | 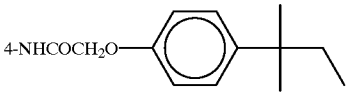 | 103-5 | 103-6 | 103-7 | 103y |

TABLE 18-continued
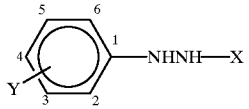
| | Y = | X = 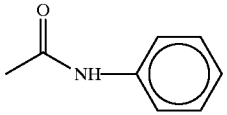 | 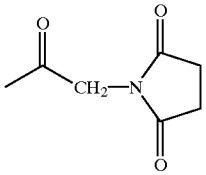 | 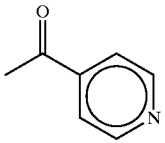 | 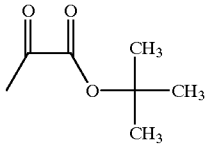 |
|---|---|---|---|---|---|
| 104 | 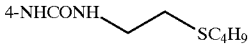 | 104-8 | 104-9 | 104w' | 103x |
| 105 | 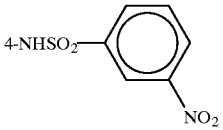 | 105-8 | 105-9 | 105w' | 105x |

TABLE 19
| | | Y—NHNH—X | | | |
|---|---|---|---|---|---|
| | | X = | | | |
| | Y = | 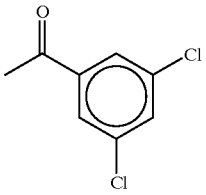 | 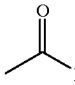 | 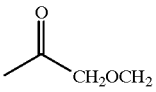 | 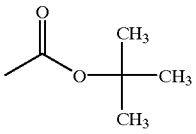 |
| 106 | 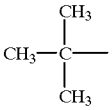 | 106-10 | 106a | 106m | 106y |
| 107 | 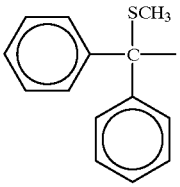 | 107-10 | 107a | 107m | 107y |
| 108 | 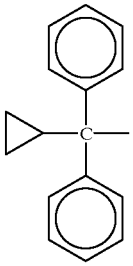 | 108-10 | 108a | 108m | 108y |
| 109 | 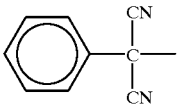 | 109-10 | 109a | 109m | 109y |
| 110 | 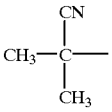 | 110-10 | 110a | 110m | 110y |
| 111 | 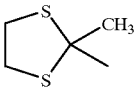 | 111-10 | 111a | 111m | 111y |

TABLE 20
| | Y—NHNH—X | | | | |
|---|---|---|---|---|---|
| | | X = | | | |
| | Y = | 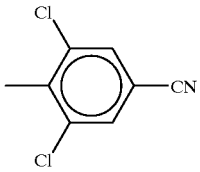 | 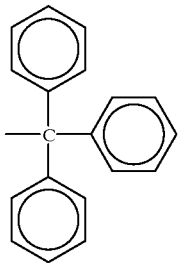 | 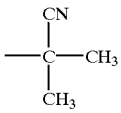 | 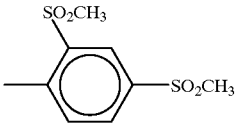 |
| 112 | 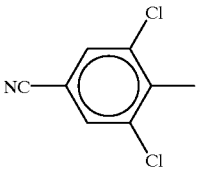 | 112-11 | 112-12 | 112-13 | 112-14 |
| 113 | 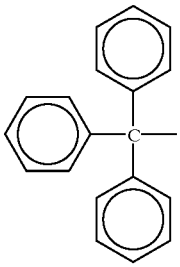 | 113-11 | 113-12 | 113-13 | 113-14 |
| 114 | 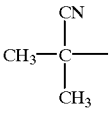 | 114-11 | 114-12 | 114-13 | 114-14 |
| 115 | 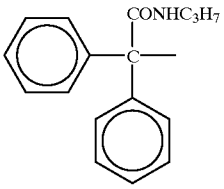 | 115-11 | 115-12 | 115-13 | 115-14 |
| 116 | 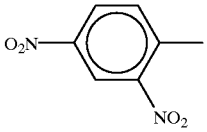 | 116-11 | 116-12 | 116-13 | 116-14 |
| 117 | 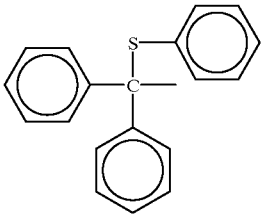 | 117-11 | 117-12 | 117-13 | 117-14 |

TABLE 21
118
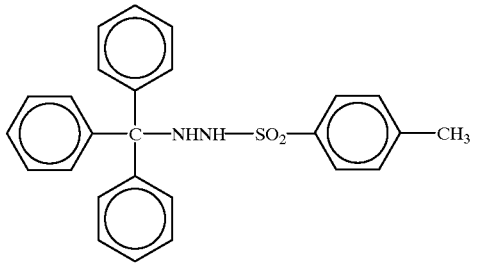
119
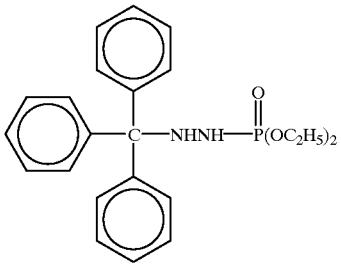
120
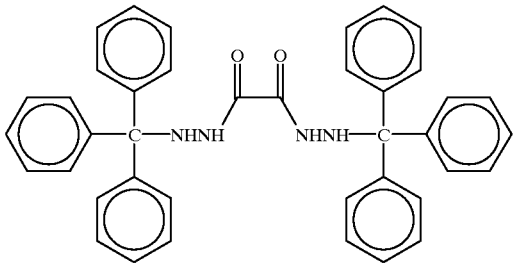
121
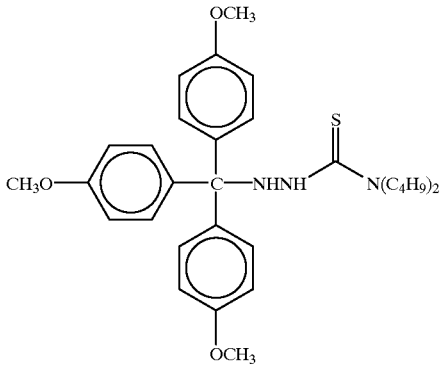
122
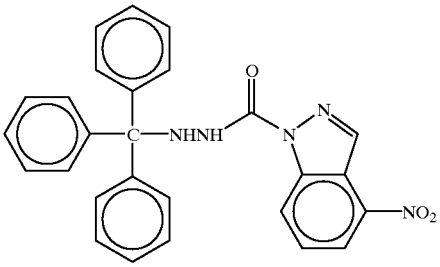

TABLE 21-continued
| | |
|---|---|
| 123 | 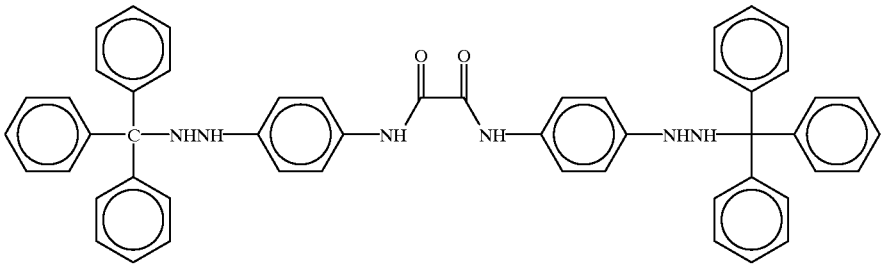 |
15
TABLE 22
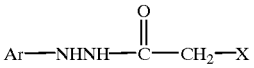
| Ar = | X = —OH | —SH | —NHCOCF$_3$ | —NHSO$_2$CH$_2$ | —NHSO$_2$ph | —N(CH$_3$)$_2$ |
|---|---|---|---|---|---|---|
| 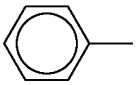 | 124a | 124b | 124c | 124d | 124e | 124f |
| 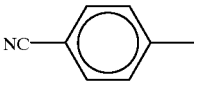 | 125a | 125b | 125c | 125d | 125e | 125f |
| 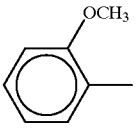 | 126a | 126b | 126c | 126d | 126e | 126f |
| 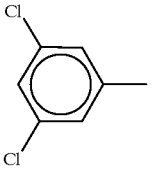 | 127a | 127b | 127c | 127d | 127e | 127f |
| 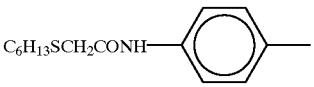 | 128a | 128b | 128c | 128d | 128e | 128f |
| 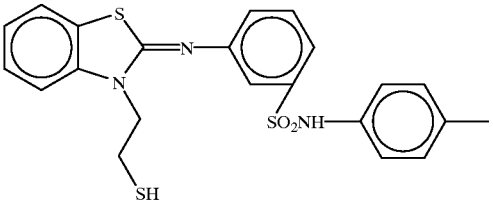 | 129a | 129b | 129c | 129d | 129e | 129f |
| 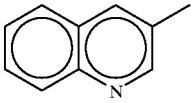 | 130a | 130b | 130c | 130d | 130e | 130f |

TABLE 22-continued

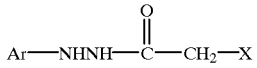

| Ar = | X = —OH | —SH | —NHCOCF$_3$ | —NHSO$_2$CH$_2$ | —NHSO$_2$ph | —N(CH$_3$)$_2$ |
|---|---|---|---|---|---|---|
| 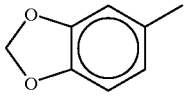 | 131a | 131b | 131c | 131d | 131e | 131f |
| 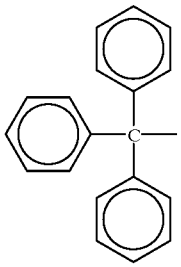 | 132a | 132b | 132c | 132d | 132e | 132f |
| 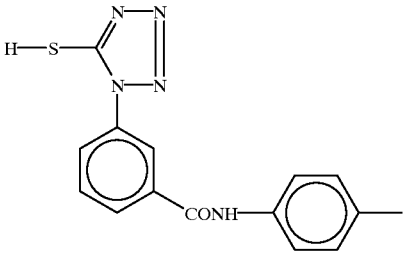 | 133a | 133b | 133c | 133d | 133e | 133f |
| 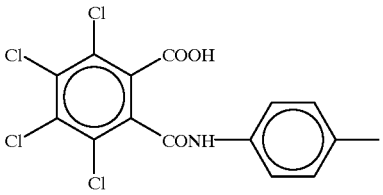 | 134a | 134b | 134c | 134d | 134e | 134f |

TABLE 23

135

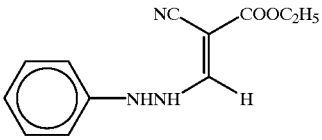

136

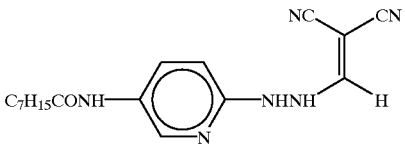

TABLE 23-continued

137

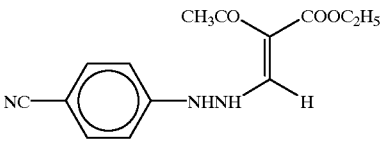

The hydrazine nucleating agent for use in the present invention may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine nucleating agent for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the hydrazine nucleating agent may be used after dispersing the powder of the hydrazine derivative in water by a method known as a solid dispersion method, using a ball mill, a colloid mill or an ultrasonic wave.

The hydrazine nucleating agent for use in the present invention may be added to an image-forming layer in the image-forming layer side on the support, or to any other binder layers, however, the hydrazine nucleating agent is preferably added to an image-forming layer or a binder layer adjacent thereto.

The addition amount of the nucleating agent for use in the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver.

In the present invention, a contrast accelerator may be used in combination with the above-described nucleating agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 to CA-6; and onium salts described in Japanese Patent Application No. 8-132836, specifically, A-1 to A-42, B-1 to B-27 and C-1 to C-14.

With respect to the synthesis method, addition method and addition amount of these contrast accelerators, those described in respective patent publications may be used.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The antifoggant for use in the present invention may be added in any form of a solution, a powder and a solid fine particle dispersion. The solid fine particle dispersion is performed using a known pulverization means (e.g., ball mill, vibrating ball mill, sand mill, colloid mill, jet mill, roller mill). At the time of solid fine particle dispersion, a dispersion aid may also be used.

Although not necessary for practicing the present invention, it is advantageous in some cases to add a mercury(II) salt as an antifoggant to an emulsion layer. Preferred mercury(II) salts to this purpose are mercury acetate and mercury bromide. The addition amount of mercury for use in the present invention is preferably from $1\times10^{-9}$ to $1\times10^{-3}$ mol, more preferably from $1\times10^{-8}$ to $1\times10^{-4}$ mol, per mol of silver coated.

The heat-developable light-sensitive material of the present invention may contain a benzoic acid for the purpose of achieving high sensitivity or preventing fog. The benzoic acid for use in the present invention may be any benzoic acid derivative but preferred examples of the structure include the compounds described in U.S. Pat. Nos. 4,784,939 and 4,152,160 and Japanese Patent Application Nos. 8-151242, 8-151241 and 8-98051. The benzoic acid for use in the present invention may be added to any site of the light-sensitive material but the layer to which the benzoic acid is added is preferably a layer on the surface having a light-sensitive layer, more preferably an organic silver salt-containing layer. The benzoic acid for use in the present invention may be added at any step during the preparation of the coating solution. In the case of adding the benzoic acid to an organic silver salt-containing layer, it may be added at any step from the preparation of the organic silver salt until the preparation of the coating solution but is preferably added in the period after the preparation of the organic silver salt and immediately before the coating. The benzoic acid for use in the present invention may be added in any form of a powder, a solution and a fine particle dispersion, or may be added as a solution containing a mixture of the benzoic acid with other additives such as a sensitizing dye, a reducing agent and a color toner. The benzoic acid for use in the present invention may be added in any amount, however, the addition amount thereof is preferably from $1\times10^{-6}$ to 2 mol, more preferably from $1\times10^{-3}$ to 0.5 mol, per mol of silver.

The heat-developable light-sensitive material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from the group consisting of halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole-)benzenesulfonate, N-methyl-N'-{3-(5-mercaptotetrazolyl)phenyl}urea and 2-mercapto-4-phenyloxazole, however, the present invention is by no means limited thereto.

The amount of the mercapto compound added is preferably from 0.0001 to 1.0 mol, more preferably from 0.001 to 0.3 mol, per mol of silver in an emulsion layer.

The light-sensitive layer for use in the present invention may contain a plasticizer or lubricant and examples thereof include polyhydric alcohols (for example, glycerin and diol described in U.S. Pat. No. 2,960,404), fatty acids or esters described in U.S. Pat. Nos. 2,588,765 and 3,121,060, and silicone resins described in British Patent 955,061.

In the present invention, a protective layer is preferably provided on the image-forming layer. The binder for the protective layer is preferably a polymer latex having a glass transition temperature of from 25 to 70° C. In this case, the polymer latex is preferably used in an amount of 50 wt % or more, preferably 70 wt % or more, of the entire binder in the protective layer. In the present invention, at least one protective layer as such is preferably provided. The binder constitution and the coating method of the protective layer are the same as those of the image-forming layer. The polymer latex for the protective layer is preferably an acryl-based, styrene-based, acryl/styrene-based, vinyl chloride-based or vinylidene chloride-based polymer latex. Specific examples of the polymer latex which is preferably used include VONCORT R3370, 4280, Nipol Lx857, a methyl acrylate/2-ethylhexyl (meth)acrylate/hydroxyethyl (meth-)acrylate/styrene/(meth)acrylic acid copolymer (all are acrylic resin type), Nipol G576 (vinyl chloride resin) and ARON D5071 (vinylidene chloride resin).

The entire amount of the binder in the protective layer for use in the present invention is from 0.2 to 5.0 g/m$^2$, preferably from 0.5 to 4.0 g/m$^2$.

For the surface protective layer for use in the present invention, any antisticking material may be used. Examples of the antisticking material include wax, silica particle, styrene-containing elastomeric block copolymer (e.g., styrene-butadiene-styrene, styrene-isoprene-styrene), cellulose acetate, cellulose acetate butyrate, cellulose propionate and a mixture thereof. The surface protective layer may also contain a cross-linking agent for forming cross-linking or a surface active agent for improving the coatability.

The image-forming layer or the protective layer of the image-forming layer for use in the present invention may contain a photoabsorbing substance or a filter dye described in U.S. Pat. Nos. 3,253,921, 2,274,782, 2,527,583 and 2,956,879, or may be mordanted with a dye as described, for example, in U.S. Pat. No. 3,282,699. The filter dye is preferably used in an amount of giving an absorbance at the exposure wavelength of from 0.1 to 3, more preferably from 0.2 to 1.5.

The light-sensitive layer for use in the present invention may contain a dye or pigment of various types so as to improve the color tone or prevent the irradiation. Any dye or pigment may be used in the light-sensitive layer for use in the present invention and example thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye may be added in any form of a solution, an emulsified product or a solid fine particle dispersion or may be added in the state mordanted with a polymer mordant. The amount of such a compound used may be determined according to the objective amount absorbed but in general, the compound is preferably used in an amount of from $1\times10^{-6}$ to 1 g/m$^2$.

The heat-developable photographic light-sensitive material of the present invention is preferably a so-called single-sided light-sensitive material comprising a support having on one side thereof at least one light-sensitive layer containing a silver halide emulsion and on the other side thereof a back layer.

In the present invention, the back layer preferably has a maximum absorption in the desired region, of from about 0.3 to 2.0. In the case when the desired region is from 750 to 1,400 nm, the back layer is preferably an antihalation layer having an optical density at from 750 to 360 nm, of from 0.005 to less than 0.5, more preferably from 0.001 to less than 0.3 and in the case when the desired range is less than 750 nm, an antihalation layer having a maximum absorption in the desired region before the formation of an image, of from 0.3 to 2.0 and an optical density at from 360 to 750 nm after the formation of an image, of from 0.005 to less than 0.3. The method for reducing the optical density after the formation of an image to the above-described range is not particularly limited, however, for example, a method of reducing the density originated in a dye using decoloration due to heating described in Belgian Patent 733,706 or a method of reducing the density using decoloration due to light irradiation described in JP-A-54-17833 may be used.

In the case when an antihalation dye is used in the present invention, the dye may be any compound as far as the compound has an objective absorption in the desired region, the absorption in the visible region can be sufficiently reduced after the processing and the back layer can have a preferred absorption spectrum form. Examples thereof include those described in the following patent publications, however, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-

16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

In the present invention, the binder suitable for the back layer is transparent or translucent and generally colorless. A natural polymer, a synthetic resin, polymer or copolymer, or a film-forming medium other than these polymers or resins may be used. Examples thereof include gelatin, gum arabi, poly(vinyl alcohol), hydroxyethyl cellulose, cellulose acetate, cellulose acetate butyrate, poly(vinyl pyrrolidone), casein, starch, poly(methacrylic acid), poly(methyl methacrylate), poly(vinyl chloride), poly(methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly(vinylidene chloride), poly(epoxides), poly(carbonates), poly(vinyl acetate), cellulose esters and poly(amides). The binder may be coated and formed after dissolving it in water or an organic solvent or in the form of an emulsion.

In the single-sided light-sensitive material of the present invention, the surface protective layer of the light-sensitive emulsion layer and/or the back layer or the surface protective layer of the back layer may containing a matting agent so as to improve the transferability. The matting agent is in general a fine particle of a water-insoluble organic or inorganic compound. Any matting agent may be used and, for example, a matting agent well known in the art may be used, such as an organic matting agent described in U.S. Pat. Nos. 1,939,213, 2,701,245, 2,322,037, 3,262,782, 3,539,344 and 3,767,448, or an inorganic matting agent described in U.S. Pat. Nos. 1,260,772, 2,192,241, 3,257,206, 3,370,951, 3,523,022 and 3,769,020. Specific examples of the organic compound which can be preferably used as a matting agent include water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea-formaldehyde-starch reaction product; and gelatin hardened by a known hardening agent and hardened gelatin subjected to coacervation hardening into a microcapsule hollow particle. Examples of the inorganic compound which can be preferably used include silicon dioxide, titanium dioxide, magnesium dioxide, aluminum oxide, barium sulfate, calcium carbonate, silver chloride desensitized by a known method, silver bromide desensitized by a known method, glass and diatomaceous earth. The matting agent may be used as a mixture of different kinds of substances. The size and shape of the matting agent is not particularly limited and the matting agent may have any particle size. In practicing the present invention, a matting agent having a particle size of from 0.1 to 30 μm is preferred. The matting agent may have either a narrow or broad particle size distribution. However, the matting agent greatly affects the haze or surface gloss of the light-sensitive material and accordingly, the particle size, shape and particle size distribution are preferably controlled according to the purpose at the preparation of the matting agent or by mixing a plurality of matting agents.

In the present invention, the back layer preferably contains a matting agent. The matting degree of the back layer is, in terms of a Beck's smoothness, from 10 to 1,200 seconds, more preferably from 50 to 700 seconds.

In the present invention, the matting agent is preferably incorporated into the outermost surface layer of the light-sensitive material, a layer which functions as the outermost surface layer, a layer close to the outer surface or a layer which acts as a so-called protective layer. The emulsion surface protective layer may have any matting degree as far as a stardust failure is not generated, however, the Beck smoothness is preferably from 500 to 10,000 seconds, more preferably from 500 to 2,000 seconds.

The heat-developable photographic emulsion for use in the present invention is coated on a support to form one or more layers. In the case of a single-layer structure, the layer must contain an organic silver salt, a silver halide, a developer, a binder and additional desired materials such as a color toner, a coating aid and other auxiliary agents. In the case of a two-layer structure, the first emulsion layer (usually a layer adjacent to the substrate) must contain an organic silver salt and a silver halide and the second layer or both layer must contain some other components. A structure constituted by a single emulsion layer containing all components and a protective topcoat may also be used. A multi-color light-sensitive heat-developable photographic light-sensitive material may have a structure such that a combination of the above-described two layers is provided for respective colors or as described in U.S. Pat. No. 4,708,928, a structure such that a single layer contains all components. In the case of a multi-dye multi-color light-sensitive heat-developable photographic material, respective emulsion layers are generally kept away from each other by using a functional or non-functional barrier layer between respective light-sensitive layers as described in U.S. Pat. No. 4,460,681.

A backside resistive heating layer described in U.S. Pat. Nos. 4,460,681 and 4,374,921 may also be used in the light-sensitive heat-developable photographic image system.

In the present invention, the layers such as a light-sensitive layer, a protective layer and a back layer each may contain a hardening agent. Examples of the hardening agent include polyisocyanates described in U.S. Pat. No. 4,281,060 and JP-A-6-208193, epoxy compounds described in U.S. Pat. No. 4,791,042, and vinyl sulfone-based compounds described in JP-A-62-89048.

In the present invention, a surface active agent may also be used so as to improve the coatability or electrostatic charge property. Examples of the surface active agent include nonionic, anionic, cationic and fluorine-based surface active agents, and these may be appropriately selected and used. Specific examples thereof include fluorine-based polymer surface active agents described in JP-A-62-170950 and U.S. Pat. No. 5,380,644, fluorine-based surface active agents described in JP-A-60-244945 and JP-A-63-188135, polysiloxane-based surface active agents described in U.S. Pat. No. 3,885,965, and polyalkylene oxides and anionic surface active agents described in JP-A-6-301140.

The heat-developable photographic emulsion for use in the present invention can be coated in general on a support of various types. Typical examples of the support include polyester film, undercoated polyester film, poly(ethylene terephthalate) film, polyethylene naphthalate film, nitrocellulose film, cellulose ester film, poly(vinyl acetal) film, polycarbonate film, related or resinous material, glass, paper and metal. A flexible substrate, particularly, a paper support partially acetylated or coated with baryta and/or an α-olefin polymer, preferably, a polymer of an α-olefin having from 2 to 10 carbon atoms, such as polyethylene, polypropylene or ethylene-butene copolymer, is most commonly used. The support may or may not be transparent but is preferably transparent. Of the above-described substrate, a biaxially stretched polyethylene terephthalate having a thickness of approximately from 75 to 200 μm is preferred.

When a plastic film is passed through a heat-developing apparatus and processed at 80° C. or more, the film is generally changed in the dimension. If this processed material is used for the manufacture of a printing plate, the change in the dimension causes a serious problem at the time of precision multi-color printing. Accordingly, in the present invention, it is preferred to use a film designed to undergo little change in the dimension by relaxing the internal strain remaining in the film at the biaxial stretching and thereby eliminating the heat shrinkage distortion generated during the heat development. For example, polyethylene terephthalate heat-treated at from 100 to 210° C. before a heat-developable photographic emulsion is coated thereon, is preferably used. Also, a film having a high glass transition point is preferred and a film of polyether ethyl ketone, polystyrene, polysulfone, polyether sulfone, polyarylate or polycarbonate may be used.

For the purpose of preventing the electrostatic charge, the heat-developable light-sensitive material of the present invention may comprise a metallized layer or a layer containing a soluble salt (e.g., chloride, nitrate), an ionic polymer described in U.S. Pat. Nos. 2,861,056 and 3,206,313, an insoluble inorganic salt described in U.S. Pat. No. 3,428,451, or tin oxide fine particles described in JP-A-60-252349 and JP-A-57-104931.

With respect to the method for obtaining a color image using the heat-developable light-sensitive material of the present invention, the method described in JP-A-7-13295, from page 10, left column, line 43 to page 11, left column, line 40 may be used. Examples of the stabilizer for a color dye image include chose described in British Patent 1,326,889, U.S. Pat. Nos. 3,432,300, 3,698,909, 3,574,627, 3,573,050, 3,764,337 and 4,042,394.

The heat-developable photographic emulsion for use in the present invention may be coating by various coating operations such as dip coating, air knife coating, flow coating or extrusion coating using a hopper of a type described in U.S. Pat. No. 2,681,294. If desired, two or more layers may be simultaneously coated by a method described in U.S. Pat. Nos. 2,761,791 and 837,095.

The heat-developable photographic material of the present invention may comprise additional layers such as a dye-accepting layer for accepting a moving dye image, an opaque layer which is preferred in the case of reflective printing, a protective topcoat layer or a primer layer known in the photothermic photographic technology. The light-sensitive material of the present invention is preferably designed so that an image can be formed by the light-sensitive material alone. It is not preferred to form a functional layer necessary for forming an image, such as an image-receiving layer, as a separate light-sensitive material.

The heat-developable light-sensitive material of the present invention may be developed by any method but the development is usually performed by elevating the temperature of the light-sensitive material after the imagewise exposure. Preferred embodiments of the heat-developing apparatus used include, as a type of contacting a heat-developable light-sensitive material with a heat source such as heat roller or heat drum, the heat-developing apparatuses described in JP-B-5-56499, Japanese Patent No. 684453, JP-A-9-292695, JP-A-9-297385 and International Patent WO95/30934, and as a non-contacting type, the heat-developing apparatuses described in JP-A-7-13294, International Patents WO97/28489, WO97/28488 and WO97/28287. Of these, a non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing the heat-developable light-sensitive material of the present invention from uneven processing due to the above-described change in the dimension at the time of heat development, a method of heating the light-sensitive material at a temperature of from 80° C. to less than 115° C. for 5 seconds or more such that an image is not formed and then heat-developing it at 110° C. or more to form an image (a so-called multi-stage heating method) is effective.

The light-sensitive material of the present invention may be exposed by any method but the light source for the exposure is preferably a laser ray. The laser ray for use in the present invention is preferably a gas laser, a YAG laser, a dye laser or a semiconductor laser. The semiconductor laser may be a second harmonic generation device.

The light-sensitive material of the present invention has a low haze at the exposure and is liable to incur generation of interference fringes. For preventing the generation of interference fringes, a technique of entering a laser ray obliquely with respect to the light-sensitive material disclosed in JP-A-5-113548 and a method of using a multimode laser disclosed in International Patent WO95/31754 are known and these techniques are preferably used.

The light-sensitive material of the present invention is preferably exposed such that the laser rays are overlapped and the scanning lines are not viewed as described in *SPIE,* Vol. 169, "Laser Printing", pages 116 to 128 (1979), JP-A-4-51043 and WO95/31754.

The present invention will be described in greater detail below by referring to the following Examples, however, the present invention should not be construed as being limited thereto.

EXAMPLE 1

Preparation of Silver Halide Grains
(Emulsion A)

Into 700 ml of water, 11 g of phthalized gelatin, 30 mg of potassium bromide and 10 mg of sodium benzenesulfonate were dissolved, and after adjusting the pH to 5.0 at a temperature of 55° C., 159 ml of an aqueous solution containing 18.6 g of silver nitrate and an aqueous solution containing 1 mol/l of potassium bromide were added by a control double jet method over 6 minutes and 30 seconds while keeping the pAg at 7.7. Subsequently, 476 ml of an aqueous solution containing 55.5 g of silver nitrate and an aqueous halogen salt solution containing 1 mol/l of potassium bromide were added by a control double jet method over 28 minutes and 30 seconds while keeping the pAg at 7.7. Thereafter, the pH was lowered to cause coagulation precipitation to thereby effect desalting, 0.17 g of Compound A and 23.7 g of deionized gelatin (calcium content: 20 ppm or less) were added, and the pH and the pAg were adjusted to 5.9 and 8.0, respectively. The grains obtained were cubic grains having an average grain size of 0.1 μm, a coefficient of variation of the projected area of 8% and a (100) face ratio of 93%.

The temperature of the thus-obtained silver halide grains was elevated to 60° C. and thereto 76 μmol/mol-Ag of sodium benzenethiosulfonate was added. After 3 minutes, 154 μmol/mol-Ag was further added and then, the grains were ripened for 100 seconds.

Thereafter, Sensitizing Dye A shown below and Compound B were added in an amount of $12.8\times10^{-4}$ mol and $6.4\times10^{-3}$ mol, respectively, per mol of silver halide with stirring while keeping the emulsion at 40° C. After 20 minutes, the emulsion was rapidly cooled to 30° C. to complete the preparation of Silver Halide Emulsion A.

a coefficient of variation of 30%. The grain size was measured by Master Sizer X manufactured by Malvern Instruments Ltd. A cooling operation was performed to set the temperature to a desired dispersion temperature by fixing a coiled heat exchanger before and after the interaction chamber and controlling the temperature of the refrigerant. Thus, Sensitizing Dye A:

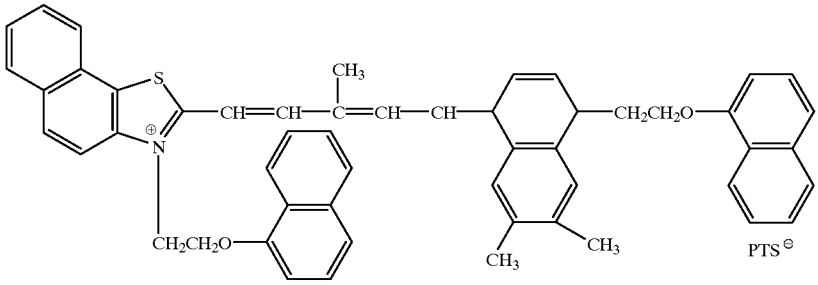

Compound A:

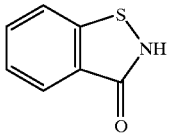

Compound B:

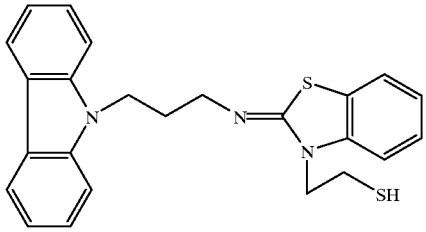

Preparation of Organic Acid Silver Dispersion (Organic Acid Silver A)

6.1 g of arachic acid, 37.6 g of behenic acid, 700 ml of distilled water, 70 ml of tert-butanol and 123 ml of an aqueous 1N-NaOH solution were mixed and reacted by stirring at 75° C. for one hour, and then the temperature of the mixture was lowered to 65° C. Subsequently, 112.5 ml of an aqueous solution containing 19.2 g of silver nitrate was added over 45 seconds and allowed to stand as it is for 5 minutes, and then the temperature was lowered to 30° C. Thereafter, the solid content was separated by suction filtration and the solid content was washed with water until the conductivity of the filtered water became 30 μS/cm. The thus-obtained solid content was not dried but handled as a wet cake. To this wet cake corresponding to 100 g of the dry solid content, 5 g of polyvinyl alcohol (PVA-205, trade name) and water were added to make the total amount of 500 g and the resulting mixed solution was preparatorily dispersed in a homomixer.

Then, the preparatorily dispersed stock solution was treated three times in a dispersing machine (Microfluidizer M-110S-EH, trade name, manufactured by Microfluidex International Corporation, using G10Z interaction chamber) under a pressure controlled to 1,750 kg/cm$^2$ to obtain Organic Acid Silver Dispersion A. The organic acid silver grains contained in the thus-obtained organic acid silver dispersion were acicular grains having an average short axis length of 0.04 μm, an average long axis length of 0.8 μm and Organic Acid Silver A having a silver behenate content of 85 mol % was prepared.

Preparation of Solid Fine Particle Dispersion of 1,1-Bis(2-hydroxy-3,5-dimethylphenyl)-3,5,5-trimethylhexane To 20 g of 1,1-bis(2-hydroxy-3,5-dimethylphenyl)-3,5,5-trimethylhexane, 3.0 g of MP Polymer (MP-203, produced by Kuraray Co., Ltd.) and 77 ml of water were added and thoroughly stirred. The resulting mixture as a slurry was left standing for 3 hours. Thereafter, 360 g of 0.5-mm zirconia beads were prepared and placed together with the slurry in a vessel. The contents in the vessel were dispersed in a dispersing machine (¼G Sand Grinder Mill, manufactured by Imex KK) for 3 hours to prepare a reducing agent solid fine particle dispersion. In this dispersion, 80 wt % of the particles had a particle size of from 0.3 to 1.0 μm.

Preparation of Solid Fine Particle Dispersion of Tribromomethylphenylsulfone

To 30 g of tribromomethylphenylsulfone, 0.5 g of hydroxypropylmethyl cellulose, 0.5 g of Compound C and 88.5 g of water were added and thoroughly stirred. The resulting mixture as a slurry was left standing for 3 hours. Thereafter, an antifoggant solid fine particle dispersion was prepared in the same manner as in the preparation of a reducing agent solid fine particle dispersion. In the dispersion, 80 wt % of the particles had a particle size of from 0.3 to 1.0 μm.

Preparation of Coating Solution for Emulsion Layer

The binder, raw materials and Silver Halide Emulsion A shown below were added to the organic acid silver fine crystal dispersion prepared above each per mol of silver in the dispersion and water was added thereto to prepare a coating solution for the emulsion layer.

| | |
|---|---|
| Binder: LACSTAR 3307B (SBR latex, produced by Dai-Nippon Ink & Chemicals, Inc., glass transition temperature: 17° C.) | as solid 470 g |
| 1,1-Bis(2-hydroxy-3,5-dimethylphenyl)-3,5,5-trimethylhexane | as solid 110 g |
| Tribromomethylsulfone | as solid 25 g |
| Sodium benzenethiosulfonate | 0.25 g |
| Polyvinyl alcohol (MP-203, produced by Kuraray Co., Ltd.) | 46 g |
| 6-iso-Butylphthalazine | 0.12 mol |
| Dye A | 0.62 g |
| Nucleating agent | kind and amount added are shown in Table 24 |
| Silver Halide Emulsion A | as Ag 0.05 mol |

Compound C:

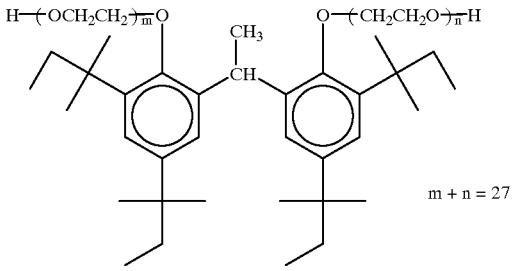

Dye A:

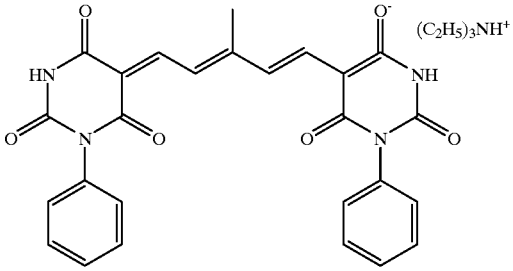

Preparation of Coating Solution for Protective Layer of Emulsion Surface 3.75 g of $H_2O$ was added to 109 g of a polymer latex (a 59/9/26/5/1 copolymer of methyl methacrylate/styrene/2-ethylhexyl acrylate/2-hydroxyethyl methacrylate/methacrylic acid, glass transition temperature: 55° C.) having a solid content of 27.5%. Thereto, 4.5 g of benzyl alcohol as a film forming aid, 0.45 g of Compound D, 0.125 g of Compound E, 0.0125 mol of Compound F and 2.25 g of polyvinyl alcohol (PVA-217, produced by Kuraray Co., Ltd.) were added and further, $H_2O$ was added to make 150 g, thereby preparing a coating solution.

Compound D:

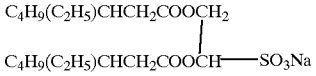

Compound E:

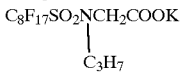

-continued

Compound F:

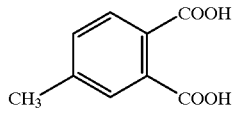

Preparation of PET Support with Back/Undercoat Layer (1) Support

PET having IV (intrinsic viscosity) of 0.66 (determined at 25° C. in a 6/4 (by weight) mixture of phenol/tetrachloroethane) was obtained using a terephthalic acid and ethylene glycol according to an ordinary method. The PET was pelletized, dried at 130° C. for 4 hours, melted at 300° C., extruded from a T die and then rapidly cooled to prepare an unstretched film so as to have a thickness of 120 μm after the heat setting.

This film was longitudinally stretched to 3.3 times using rollers different in the peripheral speed and then transversely stretched to 4.5 times by a tenter at a temperature of 110° C. and 130° C., respectively. Subsequently, the film was heat-set at 240° C. for 20 seconds and then relaxed by 4% in the transverse direction at the same temperature. Thereafter, the chuck part of the tenter was slit and the film was knurled at the both edges and then taken up at 4.8 kg/cm$^2$. Thus, a roll having a width of 2.4 m, a length of 3,500 m and a thickness of 120 μm was obtained.

| | |
|---|---|
| (3) Undercoat Layer (a) | |
| Polymer Latex (1) (styrene/butadiene/hydroxyethyl methacrylate/divinylbenzene = 67/30/2.5/0.5 (wt %)) | 160 mg/m$^2$ |
| 2,4-Dichloro-6-hydroxy-s-triazine | 4 mg/m$^2$ |
| Matting agent (polystyrene, average particle size: 2.4 μm) | 3 mg/m$^2$ |
| (3) Undercoat Layer (b) | |
| Deionized gelatin ($Ca^{2+}$ content: 0.6 ppm, jelly strength: 230 g) | 50 mg/m$^2$ |
| (4) Electrically Conductive Layer | |
| JURIMER ET-410 (produced by Nippon Junyaku KK) | 96 mg/m$^2$ |
| Alkali-processed gelatin (molecular weight: about 10,000, $Ca^{2+}$ content: 30 ppm) | 42 mg/m$^2$ |
| Deionized gelatin ($Ca^{2+}$ content: 0.6 ppm) | 8 mg/m$^2$ |
| Compound A | 0.2 mg/m$^2$ |
| Polyoxyethylene phenyl ether | 10 mg/m$^2$ |
| SUMITEX RESIN M-3 (a water-soluble melamine compound, produced by Sumitomo Chemical Co., Ltd.) | 18 mg/m$^2$ |
| Dye A | in a coated amount to give an optical density at 780 nm of 1.0 |
| $SnO_2$/Sb (9/1 by weight, acicular fine particles, long axis/short axis = 20 to 30, produced by Ishihara Sangyo Kaisha Ltd.) | 160 mg/m$^2$ |
| Matting agent (polymethyl methacrylate, average particle size of 5 μm) | 7 mg/m$^2$ |
| (5) Protective Layer | |
| Polymer Latex (2) (a 59/9/26/5/1 (wt %) copolymer of methyl methacrylate/styrene/2-ethylhexyl acrylate/2-hydroxyethyl methacrylate/methacrylic acid) | 1,000 mg/m$^2$ |
| Polystyrenesulfonate (molecular weight: 1,000 to 5,000) | 2.6 mg/m$^2$ |
| CELLOZOL 524 (produced by Chukyo Yushi KK) | 25 mg/m$^2$ |

-continued

| | |
|---|---|
| SUMITEX RESIN M-3<br>(a water-soluble melamine compound,<br>produced by Sumitomo Chemical Co., Ltd.) | 218 mg/m$^2$ |

On one side of the support, the undercoat layer (a) and the undercoat layer (b) were sequentially coated and dried at 180° C. for 4 minutes. Subsequently, on the surface opposite to the surface having coated thereon the undercoat layer (a) and the undercoat layer (b), the electrically conductive layer and the protective layer were sequentially coated and dried at 180° C. for 30 seconds to manufacture a PET support with a back/undercoat layer.

The thus-obtained PET support with a back/undercoat layer was set at 160° C., placed in a heat treatment zone having a total length of 30 m and automatically transported at a tension of 14 g/cm$^2$ and a transportation speed of 20 m/min. Thereafter, the support was passed through a zone at 40° C. over 15 seconds and taken up at a take-up tension of 10 kg/cm$^2$.

Compound A:

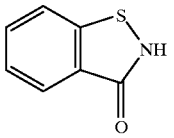

Dye A:

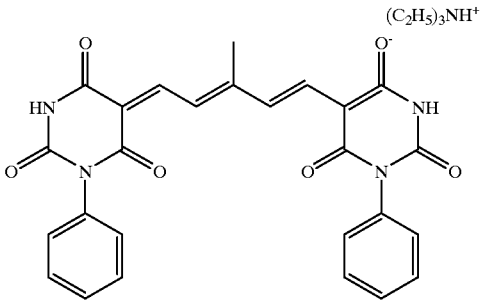

Preparation of Heat-Developable Light-Sensitive Material

On the undercoat layer of the PET support with a back/undercoat layer, the coating solution for the emulsion layer prepared above was coated to have a coated silver amount of 1.6 g/m$^2$. Thereon, the coating solution for the protective layer of the emulsion surface prepared above was coated to have a coated polymer latex amount of 2.0 g/m$^2$, simultaneously with the emulsion coating solution by overlaying one on another.

Evaluation of Photographic Performance (Exposure)

The thus-obtained coated sample was exposed to a xenon flash light having an emission time of $10^{-6}$ second through an interference filter having a peak at 780 nm and a step wedge.

(Heat Development)

The exposed sample was heat-developed at 115° C. for 20 seconds in a heat-developing apparatus shown in FIG. 1. In the FIGURE, reference numeral 1 represents a halogen lamp, 2: a heat drum, 3: a feed roller, 4: an endless belt, 5: a heat-developable light-sensitive material, 6: an outlet, 7: a guide plate, 8: paired feed rollers, 9: a plane guide plate, 10: paired feed rollers, and 11: a cooling fan.

(Evaluation of Photographic Performance)

The image obtained was evaluated by a Macbeth densitometer TD904 (visible density). The measurement results of Dmin, sensitivity (a reciprocal of the ratio of the exposure amount necessary for giving a density 1.0 higher than Dmin) and contrast were evaluated. The sensitivity was expressed by a relative value to the sensitivity of the photographic material 1 which is taken as 100. The contrast was expressed by a gradient of a straight line connecting the points at the density of 0.3 and the density of 3.0, with the abscissa being a logarithm of the exposure amount.

Separately, the sample after the coating was aged in an environment at 50° C. and 75% RH for 3 days and then heat-developed. Thereafter, in the same manner as above, Dmin of the image obtained on the sample was evaluated.

The results of evaluation on respective light-sensitive materials are shown in Table 24.

TABLE 24

| Heat-Developable Light-Sensitive Material | Nucleating Agent | Amount Added (mol) | Compound of Formula (I) | Amount added (mol) | Dmin (immediately after coating) | Dmin (after aging at 50° C., 57% RH for 3 days) | Relative Sensitivity | Contrast | Remarks |
|---|---|---|---|---|---|---|---|---|---|
| 1 | — | — | — | — | 0.08 | 0.20 | 100 | evaluation impossible | |
| 2 | — | — | I-3 | 0.01 | 0.07 | 0.09 | 90 | evaluation impossible | |
| 3 | C-1 | $9 \times 10^{-3}$ | — | — | 0.24 | 1.20 | 200 | 8 | |
| 4 | " | " | I-3 | 0.01 | 0.10 | 0.20 | 185 | 13 | Invention |
| 5 | " | " | I-5 | " | 0.10 | 0.20 | 190 | 15 | " |
| 6 | " | " | I-6 | " | 0.11 | 0.22 | 190 | 14 | " |
| 7 | C-42 | " | — | — | 0.26 | 1.30 | 196 | 9 | |
| 8 | " | " | I-5 | 0.01 | 0.10 | 0.22 | 186 | 15 | Invention |
| 9 | " | " | I-6 | 0.01 | 0.11 | 0.22 | 186 | 15 | " |
| 10 | " | " | I-3 | 0.02 | 0.09 | 0.16 | 173 | 16 | " |
| 11 | C-8 | " | — | — | 0.29 | 1.45 | 194 | 8 | |
| 12 | " | " | I-3 | 0.01 | 0.11 | 0.22 | 179 | 14 | Invention |
| 13 | C-57 | " | — | — | 0.28 | 1.40 | 200 | 8 | |
| 14 | " | " | I-7 | 0.01 | 0.10 | 0.19 | 185 | 14 | Invention |
| 15 | " | " | I-5 | 0.01 | 0.10 | 0.21 | 190 | 15 | " |

TABLE 24-continued

| Heat-Developable Light-Sensitive Material | Nucleating Agent | Amount Added (mol) | Compound of Formula (I) | Amount added (mol) | Dmin (immediately after coating) | Dmin (after aging at 50° C., 57% RH for 3 days) | Relative Sensitivity | Contrast | Remarks |
|---|---|---|---|---|---|---|---|---|---|
| 16 | 54a | " | — | — | 0.32 | 1.60 | 200 | 9 | |
| 17 | " | " | I-3 | 0.01 | 0.12 | 0.24 | 190 | 15 | Invention |
| 18 | " | " | I-7 | 0.01 | 0.11 | 0.22 | 185 | 15 | " |
| 19 | " | " | Comparison 1 | 0.01 | 0.21 | 0.63 | 120 | 10 | |

Comparison 1:

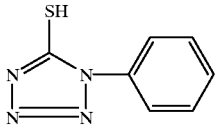

It is seen that samples of the present invention were awarded with photographic performance of low fog, high contrast and high sensitivity.

EXAMPLE 2

The heat-developing apparatus used in Example 1 was modified to have the same structure as the heat-developing apparatus shown in FIG. 3 of JP-A-7-13294, by providing two kinds of heat sources in series, so that the light-sensitive material can be continuously heated in two stages. The coated samples were subjected to the following heat development processings using this heat-developing apparatus. As a result, samples of the present invention exhibited good results.

(1) Processing (a)

Processing at 90° C. for 10 seconds (conditions of not forming an image) and then processing at 115° C. for 30 seconds.

(2) Processing (c)

Processing at 105° C. for 10 seconds (conditions of not forming an image) and then processing at 115° C. for 30 seconds.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support and at least one image-forming layer, and containing a light-insensitive silver salt, a light-sensitive silver halide and a binder, wherein said light-sensitive material comprises at least one image-forming layer which contains:

a light-sensitive silver halide which has been spectrally sensitized to from 750 to 1,400 nm; and a binder comprising a polymer latex having a glass transition temperature of from −30° C. to 40° C. in an amount of not less than 50 wt % based on the total weight thereof, and wherein said light-sensitive material further contains a nucleating agent and at least one compound represented by formula (I) in an image-forming layer or a layer adjacent thereto:

(I)

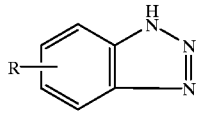

wherein R represents a hydrogen atom, an alkyl group having from 1 to 4 carbon atoms, an aryl group, a halogen atom, an amino group, a nitro group, a substituted or unsubstituted carboxylic acid group or a salt thereof, or a sulfonic acid group or a salt thereof.

2. The heat-developable light-sensitive material of claim 1, wherein said nucleating agent is at least one compound selected from a substituted alkene derivative represented by formula (1), a substituted isooxazole derivative represented by formula (2) and a specific acetal compound represented by formula (3):

(1)

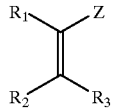

(2)

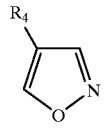

(3)

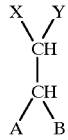

wherein, in formula (1), $R_1$, $R_2$, and $R_3$ each independently represents a hydrogen atom or a substituent selected from the group consisting of halogen, alkyl, alkenyl, alkynyl, aryl, heterocycle, quaternized nitrogen-containing heterocycle, acyl, alkoxycarbonyl, aryloxycarbonyl, carbamoyl, carboxy or salt thereof, imino, imino group substituted by N atom, thiocarbonyl, sulfonylcarbamoyl, acylcarbamoyl, sulfamoylcarbamoyl, carbazoyl, oxalyl, oxamoyl, cyano, thiocarbamoyl, hydroxy or counter salt thereof, alkoxy, aryloxy, heterocyclic oxy, acyloxy, alkoxycarbonyloxy, aryloxycarbonyloxy, carbamoyloxy, sulfonyloxy, amino, alkylamino, arylamino, heterocyclic amino, acylamino, sulfonamido, ureido, thioureido, imido, alkoxycarbonylamino, aryloxycarbonylamino, sulfamoylamino, semicarbazide, thiosemicarbazide, hydrazino, quaternary ammonio, oxamoylamino, alkylsulfonylureido, arylsulfonylureido, acylureido, acylsulfamoylamino, nitro, mercapto, alkylthio, arylthio, heterocyclic thio, acylthio, alkylsulfonyl, arylsulfonyl, alkylsulfinyl, arylsulfinyl, sulfo or salt thereof, sulfamoyl, acylsulfamoyl, sulfonylsulfamoyl or salt thereof, phosphoryl, a group containing phosphoramide or phosphoric acid ester structure, silyl and stannyl, Z represents an election withdrawing group selected from the group consisting of cyano, alkoxycarbonyl, aryloxycarbonyl, carbamoyl, imino, imino substituted by N atom, thiocarbonyl, sulfamoyl, alkylsulfonyl, arylsulfonyl, nitro, halogen, perfluoroalkyl, perfluoroalkanamido, sulfonamido, acyl, formyl, phosphoryl, carboxy or a salt thereof, sulfo or a salt thereof, heterocycle, alkenyl, alkynyl, acyloxy, acylthio, sulfonyloxy and aryl substituted by any of the above groups, or a silyl group selected from the group consisting of trimethylsilyl, t-butyldimethylsilyl, phenyldimethylsilyl, triethylsilyl, triisopropylsilyl and trimethylsilyldimethylsilyl, and $R_1$ and Z, $R_2$ and $R_3$, $R_1$ and $R_2$ or $R_3$ and Z may be combined with each other to form a ring structure selected from the group consisting of non-aromatic carbocyclic ring and non-aromatic heterocyclic ring;

wherein, in formula (2), $R_4$ represents an aryl group or an electron withdrawing group selected from the group consisting of cyano, nitro, acyl, formyl, alkoxycarbonyl, aryloxycarbonyl, alkylsulfonyl, arylsulfonyl, carbamoyl, sulfamoyl, trifluoromethyl, phosphoryl, imino, saturated heterocycle, and unsaturated heterocycle; and wherein, in formula (3), X and Y each independently represents a hydrogen atom or a substituent selected from the group of substituents for $R_1$, $R_2$ and $R_3$ in formula (1), A and B each independently represents an alkoxy group, an alkylamino group, an alkylamino group, an aryloxy group, an alkylthio group, an anilino group, a heterocyclic oxy group, a heterocyclic thio group or a heterocyclic amino group, and X and Y may be combined with each other to form a ring structure selected from the group consisting of a non-aromatic carbocyclic ring or a non-aromatic heterocyclic ring, or A and B may be combined with each other to form a 5-, 6-, or 7-membered non-aromatic heterocyclic ring having a total carbon atom number of from 1 to 40.

3. The heat-developable light-sensitive material of claim 1, wherein said nucleating agent is a hydrazine compound.

4. The heat-developable light-sensitive material of claim 2, wherein said nucleating agent is a compound represented by formula (1).

5. The heat-developable light-sensitive material of claim 2, wherein said nucleating agent is a compound represented by formula (2).

6. The heat-developable light-sensitive material of claim 2, wherein said nucleating agent is a compound represented by formula (3).

7. The heat-developable light-sensitive material of claim 2, wherein said compound represented by formula (1), (2) or (3) is present in an amount of from $1\times10^{-6}$ to 1 mol per mol of silver.

8. The heat-developable light-sensitive material of claim 1, wherein the compound represented by formula (I) is present in an amount of from $10^{-4}$ to 1 mol per mol of the entire amount of silver.

9. The heat-developable light-sensitive material of claim 1, wherein the amount of said polymer latex constituting said binder is not less than 70 wt %.

10. The heat-developable light-sensitive material of claim 9, wherein the compound represented by formula (I) is present in an amount of from $10^{-4}$ to 0.3 mol per mol of the entire amount of silver.

11. The heat-developable light-sensitive material of claim 1, wherein in the compound according to formula (I), R is selected from the group consisting of a hydrogen atom, a methyl group, an ethyl group, a butyl group, a phenyl group, a chlorine atom, and a bromine atom.

12. The heat-developable light-sensitive material of claim 1, wherein R is selected from the group consisting of

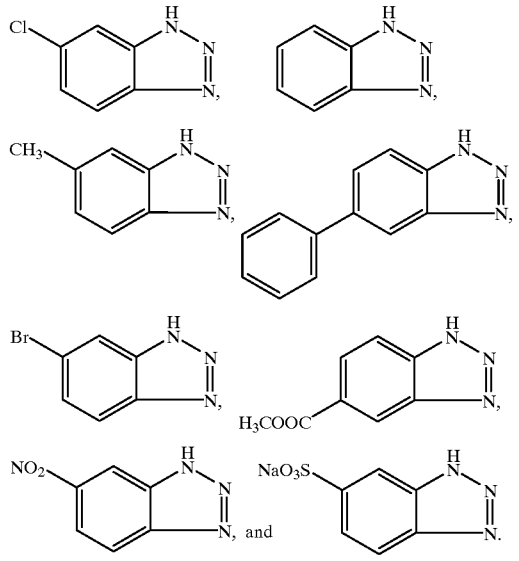

* * * * *